US005455140A

United States Patent [19]

Texter et al.

[11] Patent Number: 5,455,140

[45] Date of Patent: * Oct. 3, 1995

[54] METHINE-DYE RELEASING COUPLERS FOR HEAT IMAGE SEPARATION SYSTEMS

[75] Inventors: John Texter, Rochester; Thomas R. Welter, Webster; David T. Southby; Jared B. Mooberry, both of Rochester, all of N.Y.

[73] Assignee: Eastman Kodak Company, Rochester, N.Y.

[ * ] Notice: NOTE-DISCLAIMER The portion of the term of this patent subsequent to Dec. 14, 2010 has been disclaimed.

[21] Appl. No.: 250,145

[22] Filed: May 27, 1994

[51] Int. Cl.[6] ..... G03C 8/12; G03C 8/40

[52] U.S. Cl. ..... 430/203; 430/226; 430/546

[58] Field of Search ..... 430/203, 226, 430/546, 559

[56] References Cited

U.S. PATENT DOCUMENTS

| | | | |
|---|---|---|---|
| 3,743,504 | 7/1973 | Dappen et al. | 430/214 |
| 4,141,730 | 2/1979 | Minagawa et al. | 430/504 |
| 4,248,962 | 2/1981 | Lau | 430/544 |
| 4,420,556 | 12/1983 | Booms et al. | 430/549 |
| 4,483,914 | 11/1984 | Naito et al. | 430/203 |
| 4,507,380 | 3/1985 | Naito et al. | 430/203 |
| 4,584,267 | 4/1986 | Masukawa et al. | 430/203 |
| 4,840,884 | 6/1989 | Mooberry et al. | 430/203 |
| 4,948,698 | 8/1990 | Komamura | 430/203 |
| 5,164,280 | 11/1992 | Texter et al. | 430/203 |
| 5,270,145 | 12/1993 | Willis et al. | 430/203 |
| 5,356,750 | 10/1994 | Texter | 430/203 |

FOREIGN PATENT DOCUMENTS

| | | |
|---|---|---|
| 0115303 | 10/1989 | European Pat. Off. . |
| 3324533 | 12/1984 | Germany . |

*Primary Examiner*—Richard L. Schilling
*Attorney, Agent, or Firm*—Paul A. Leipold

[57] ABSTRACT

An aqueous-developable photographic color diffusion transfer element is disclosed where this element comprises one and only one dimensionally stable support and one or more layers comprising radiation sensitive silver halide, thermal solvent for facilitating the thermal diffusion of dyes through a hydrophilic binder, a methine-dye releasing coupler, and hydrophilic binder, wherein said dye is heat diffusible in said binder and thermal solvent, and wherein said methine-dye releasing coupler is of the structure (I)

$$Cp—L—M \qquad (I)$$

where

Cp is a coupler radical substituted in the coupling position with a divalent linking group, L;

M is a methine-dye radical exhibiting selective absorption in the visible spectrum; and where the —L—M group couples off upon reaction of said coupler radical with the oxidation product of a primary amine developing agent, and where said methine-dye radical M is released from said —L—M group subsequent to the coupling off of said —L—M group.

Also disclosed in this invention is a diffusion transfer process for forming a color photographic image comprising the steps of:

exposing said element to actinic radiation; processing said element by immersing said element in an external aqueous bath containing color developer of the primary amine type;

washing said element;

drying said element to remove the imbibed water; and heating said element to effect dye diffusion transfer to an image receiving layer.

30 Claims, No Drawings

METHINE-DYE RELEASING COUPLERS FOR HEAT IMAGE SEPARATION SYSTEMS

RELATED APPLICATIONS

This application is related to the following simultaneously filed, common,ly assigned applications: Heat Development of Elements Containing Methine-Dye Releasing Couplers of Texter et al., filed May 27, 1994 as U.S. application Ser. No. 8250,146; Photographic Element Containing a High Dye-Yield Coupler with a Methine Dye Chromophore of Mooberry et al., filed May 27, 1994 as U.S. application Ser. No. 8/250,774; Photographic Element Containing a High Dye-Yield Coupler with Improved Reactivity of Mooberry et al., filed May 27, 1994 as U.S. application Ser. No. 8/250,416; Photographic Element and Process Incorporating a High Dye-Yield Image Coupler Providing Improved Granularity of Southby et al., filed May 27, 1994 as U.S. application Ser. No. 8/250,258; Photographic Element with Silver Halide Emulsion Layer of Low Developability and Having an Associated High Dye-Yield Coupler of Southby et al., filed May 27, 1994 as U.S. application Ser. No. 8/250,742; and Tight-Wrapped Photographic Element Containing a High Dye-Yield Coupler of Southby and Szajewski, filed May 27, 1994 as U.S. application Ser. No. 8/250,199. These documents are incorporated herein by reference for all that they disclose about methine dyes.

This application is related to the following commonly assigned applications filed previously: Dye Releasing Couplers for Heat Image Separation Systems of Texter et al., filed Dec. 21, 1992 as U.S. application Ser. No. 07/993,580, now U.S. Pat. No. 5,356,750; Thermal Solvents for Dye Diffusion in Image Separation Systems of Bailey et al., filed Dec. 6, 1991 as U.S. application Ser. No. 07/804,868; Thermal Solvents for Heat Image Separation Processes of Bailey et al., filed Apr. 16, 1993 as U.S. application Ser. No. 08/049,048, now U.S. Pat. No. 5,352,561; Thermal Solvents for Heat Development Processes of Bailey et al., filed Dec. 29, 1993 as U.S. application Ser. No. 08/175,002; Hydrogen Bond Donating/Accepting Thermal Solvents for Image Separation Systems of Bailey et al., filed Jun. 8, 1993 as U.S. application Ser. No. 08/073,821; Polymeric Couplers for Heat Image Separation Systems of Texter et al., filed Aug. 10, 1992 as U.S. application Ser. No. 07/927,691, now U.S. Pat. No. 5,354,642; Aqueous Developable Dye Diffusion Transfer Elements Containing Solid Particle Thermal Solvent Dispersions of Texter, filed Jan. 26, 1993 as U.S. application Ser. No. 08/008,914, now U.S. Pat. No. 5,360,695; Delamination Systems for Photographic Print Materials of Lynch and Texter, filed Dec. 7, 1993 as U.S. application Ser. No. 08/163,223, now U.S. Pat. No. 5,368,978; and Chromogenic Black and White Imaging for Heat Image Separation of Texter and Willis, filed Dec. 21, 1993 as U.S. application Ser. No. 08/170,601.

FIELD OF THE INVENTION

This invention relates to photographic systems and processes for forming a dye image in a light sensitive silver halide emulsion layer, and subsequently separating the dye image from the emulsion layer. More particularly, this invention relates to processes comprising aqueous alkaline development for forming dye images in silver. halide emulsion layers and to thermal dye-diffusion transfer of image dyes.

BACKGROUND OF THE INVENTION

In conventional "wet" or aqueous developable silver halide based color photographic processing systems, an imagewise exposed photographic element, for example color paper designed to provide color prints, is processed in a color developer solution. The developer reduces the exposed silver halide of the photographic element to metallic silver and the resulting oxidized developer reacts with incorporated dye-forming couplers to yield dye images corresponding to the imagewise exposure. As silver is generally gray and desaturates the pure colors of the dyes, it is desirable to remove it from the dye images. Silver is conventionally separated from the dye images by a process of bleaching the silver to a silver salt and removing the silver halide by using an aqueous solvent, a fixing bath. This fixing bath also removes the undeveloped original silver halide. Commonly, the bleach and fix are combined into one solution, a bleach-fix solution. Bleach-fix solutions commonly contain iron, ammonium, EDTA (ethylenediaminetetraacetic acid), thiosulfate and, after use, silver ion. These components of "wet" or aqueous silver halide processing can be the source of much of the pollution from photofinishing processes.

Heat Image Separation Systems

A novel method of imaging, whereby conventional aqueous development processes are utilized in combination with substantially dry thermally activated diffusion transfer of image dyes to a polymeric receiver has been described by Willis and Texter in U.S. Pat. No. 5,270,145, Heat Image Separation Systems, by Bailey et al. in U.S. application Ser. No. 08/049,048, filed Apr. 16, 1993, Thermal Solvents for Heat Image Separation Processes, now U.S. Pat. No. 5,352,561, by Bailey et al. in U.S. application Ser. No. 08/073,821, filed Jun. 8, 1993, Hydrogen Bond Donating/Accepting Thermal Solvents for Image Separation Systems, by Texter et al. in U.S. application Ser. No. 07/927,691, filed Aug. 10, 1992, Polymeric Couplers for Heat Image Separation Systems, now U.S. Pat. No. 5,354,642, by Texter et al. in U.S. application Ser. No. 07/993,580, filed Dec. 21, 1992, Dye-Releasing Couplers for Heat Image Separation Systems, now U.S. Pat. No. 5,356,750 and by Bailey et al. in U.S. application Ser. No. 07/804,868, filed Dec. 6, 1991, Thermal Solvents for Dye Diffusion in Image Separation Systems. The disclosures of these cited applications are incorporated herein in their entirety by reference for all that they disclose. The morphology of a photographic element for such systems generally consists of a (1) dimensionally stable support of transparent or reflection material, (2) a receiver layer to which the diffusible dyes migrate under thermal activation, (3) optionally a stripping layer, (4) one or more diffusible-dye forming layers in which the light image is captured and amplified during conventional aqueous color development, and (5) a protective overcoat. Latent image in the diffusible-dye forming layers is captured using well known silver halide technology and these images are amplified in conventional aqueous color development. After development the element is subjected to a stop/wash bath, dried, and then heated to drive the 15 diffusible-dye image to the receiver. Thereafter, the support and receiver layer are separated from the diffusible-dye forming layers by a stripping method, such as that disclosed by Texter et al. in U.S. Pat. 5,164,280, Mechanicochemical Layer Stripping in Image Separation Systems, the entire disclosure of which is incorporated herein by reference. The separated diffusible-dye forming layers may subsequently be used as a source of recoverable silver and other fine chemicals.

Diffusible-Dye Releasing Couplers

Dappen and Smith in U.S. Pat. No. 3,743,504 disclose the use of immobile diffusible-dye-forming couplers and immobile diffusible-dye-releasing couplers in a color diffusion transfer system.

Minagawa, Arai, and Ueda in U.S. Pat. No. 4,141,730 disclose the use of immobile colored coupling compounds which release diffusible dye during color development. These compounds are used to advantage in masking applications.

Lau, in U.S. Pat. No. 4,248,962, discloses dye releasing couplers wherein dyes are anchimerically released by coupling-off groups subsequent to reaction of oxidized aromatic amine developers with said couplers.

Sakanoue, Hirano, Adachi, Minami, and Kanagawa in German Offen. No. 3,324,533 A1, Booms and Holstead in U.S. Pat. No. 4,420,556, and Arakawa and Watanabe in European Patent Specification 115,303 B1 disclose the use of diffusible dye forming couplers to provide photographic materials with improved graininess.

Sakaguchi et al., in U.S. Pat. No. 4,536,467, disclose heat developable elements containing azo-dye releasing redox compounds.

Komamura et al., in U.S. Pat. No. 4,770,989, disclose heat developable photographic elements containing azo-dye releasing couplers and compounds.

Mooberry and Singer, in U.S. Pat. No. 4,840,884, disclose dye-releasing couplers that release electrically neutral dyes and wherein said dyes are released from a coupling-off group comprising a dye and a divalent linking group of the formula —L—NR—, wherein L is a divalent linking group and NR is a substituted nitrogen atom.

Komamura and Ohya, in U.S. Pat. No. 4,847,188, disclose thermally developable light-sensitive materials containing a dye-providing material. Azo-dye releasing couplers and azamethine-dye releasing couplers are disclosed therein.

Naito et al., in U.S. Pat. No. 4,507,380, disclose heat developable light-sensitive materials containing dye-releasing compounds. Kohno et al., in U.S. Pat. No. 5,032,499, disclose thermal developing light-sensitive materials containing azo-dye releasing compounds.

Texter et al., in U.S. Pat. No. 5,356,750, disclose dye releasing couplers for heat image separation systems, wherein said dyes are exemplified by azo, azamethine, and indoaniline dyes and dye precursors.

PROBLEMTO BESOLVED BY THE INVENTION

Bleach-fix solutions commonly contain iron, ammonium, EDTA, thiosulfate and, after use, silver. These components of "wet" or aqueous silver halide processing are the source of much of the pollution from photofinishing processes. There is a continuing need to reduce and eliminate effluent containing said bleach-fix components.

Thermally diffusible dyes in heat image separation systems, obtained as indoaniline dyes upon coupling of an oxidized primary amine developing agent with a cyan-, magenta-, or yellow-dye forming coupler, have limited extinction coefficients that often require an excessive amount of coated coupler and development in order to achieve a given maximum dye-density. Most such yellow image dyes, for example, have extinction coefficients in the range of 17,000–19,000 L $mol^{-1}$ $cm^{-1}$. There is a continuing need for couplers that provide dyes with significantly higher extinction coefficients, so that desired maximum dye densities can be achieved with lower levels of coated coupler and silver, and therefore with lower manufacturing cost.

Indoaniline type dyes obtained in conventional color development of heat image separation systems often have severe dye stability problems that result from heated storage or from exposure to medium or high levels of daylight. Azo type dyes often have inappropriate hue or significant unwanted absorption, and further are often photochromic, leading to variability in hue and light fastness of the image.

These and other problems may be overcome by the practice of our invention.

SUMMARY OF THE INVENTION

It is an object of our invention to reduce the amount of waste processing solution effluents generated by the overall processing system while retaining the benefits of image quality and industry compatibility which are derived from aqueous development with conventional developing solutions.

An object of the present invention is to provide improved image dye retention in the photographic element and improved image dye hue in said element. Yet another object of the present invention is to minimize the seasoning of processing solutions with diffusible dyes. An additional object of the present invention is to minimize the amount of solid waste generated in the photofinishing of color print materials.

In accordance with this invention an aqueous-developable photographic color diffusion transfer element is provided, where said element comprises one and only one dimensionally stable support and one or more layers comprising radiation sensitive silver halide, thermal solvent for facilitating the thermal diffusion of dyes through a hydrophilic binder, a mehine-dye releasing coupler, and hydrophilic binder, wherein said dye is heat diffusible in said binder and thermal solvent, and wherein said methine-dye releasing coupler is of the structure $$Cp—L—M \quad (I)$$

where

Cp is a coupler radical substituted in the coupling position with a divalent linking group, L;

M is a methine-dye radical exhibiting selective absorption in the visible spectrum; and where the —L—M group couples off upon reaction of said coupler radical with the oxidation product of a primary amine developing agent, and where said mehine-dye radical M is released from said —L—M group subsequent to the coupling off of said —L—M group.

Also provided in this invention is a diffusion transfer process for forming a color photographic image comprising the steps of:

providing an aqueous-developable photographic color diffusion transfer element comprising one and only one dimensionally stable support and one or more layers comprising radiation sensitive silver halide, thermal solvent for facilitating the thermal diffusion of dyes through a hydrophilic binder, a methine-dye releasing coupler, and hydrophilic binder, wherein said dye is heat diffusible in said binder and thermal solvent, and wherein said methine-dye releasing coupler is of the structure $$Cp—L—M \quad (I)$$

where

Cp is a coupler radical substituted in the coupling position with a divalent linking group, L;

M is a methine-dye radical exhibiting selective absorption in the visible spectrum; and where the —L—M group couples off upon reaction of said coupler radical with the oxidation product of a primary amine developing agent, and where said radical M is released from said —L—M group subsequent to the coupling off of said —L—M group;

exposing said element to actinic radiation;

processing said element by immersing said element in an external aqueous bath containing color developer of the primary amine type;

washing said element;

drying said element to remove the imbibed water; and heating said element to effect dye diffusion transfer to an image receiving layer.

ADVANTAGEOUS EFFECT OF THE INVENTION

The present invention reduces the amount of waste processing solution effluent generated by the overall processing system while retaining the benefits of image quality and industry compatibility derived from aqueous development with conventional developing solutions. The use of methine-dye releasing couplers provides several important advantages, including being able to design mehine-dye releasing couplers wherein it is possible to control independently the properties of the released dye, the properties of the linking and timing chemistry, and the properties of the parent coupler. The incorporation and generation of methine-dyes having extremely high extinction coefficients and preferred hues are particularly attractive advantages provided by the present invention.

DETAILED DESCRIPTION OF THE INVENTION

The term "nondiffusing" used herein as applied to the couplers and diffusible-dye forming compounds has the meaning commonly applied to the term in color photography and denotes materials, which for all practical purposes, do not migrate or wander through water swollen organic colloid layers, such as gelatin, comprising the sensitive elements of the invention at temperatures of 40° C. and lower. The term "diffusible" as applied. to dyes formed from these "nondiffusing" couplers and compounds in the processes has somewhat of a converse meaning and denotes materials having the property of diffusing effectively through relatively dry colloid layers of the sensitive elements in the presence of the "nondiffusing" materials from which they are derived. The terms "dye-receiving" and "image-receiving" are used synonomously herein. In the following discussion of suitable materials for use in the elements and methods of the present invention, reference is made to Research Disclosure. December 1989, Item 308119, pages 993–1015, published by Kenneth Mason Publications, Ltd., Emsworth, Hampshire PO10 7DQ, United Kingdom, the disclosure of which is incorporated herein in its entirety by reference. This publication is identified hereafter as "Research Disclosure".

The term "heat developable" as applied to photographic elements herein means that an element contains incorporated developer or reducing agent , incorporated organic silver salt, incorporated heat solvent, in addition to at least a catalytic amount of silver halide. This incorporated silver salt provides a substantial amount of the silver for oxidizing incorporated developer or reducing agent. The incorporated heat solvent is generally a polar or high dielectric constant organic material that facilitates the heat development of heat developable elements. The term "heat solvent" is not synonymous with the term "thermal solvent" used herein.

The term "thermal solvent" means an organic compound the facilitates the thermal diffusion through relatively dry gelatin or other hydrophilic binder of electrically neutral or uncharged image dyes. Uncharged here means no net charge.

The term "aqueous developable" as applied to photographic elements herein means that an element is substantially developed by immersion in an aqueous development bath. Such development baths typically contain dilute alkali and a color developing agent or a black and white developing agent or some combination of the two types of developers. A typical composition of such a development bath is described, for example, in the Examples section of the present specification under the heading Processing and Sensitometry. Such development baths, in certain situations, may be devoid of developing agent, in cases where developing agents or developing agent precursors are incorporated in the photographic element. A description of such a system, with explicit compositions for such baths is found in U.S. Pat. No. 5,210,007, the disclosure of which is incorporated herein by reference. The term "aqueous developable" as applied to photographic elements herein means further that the element, when developed is an aqueous development bath, is not significantly foggedby incorporated organic silver salts that physically develop when contacted with aqueous alkaline developing solutions containing black and white or color developing agents. The term "aqueous developable" as applied to photographic elements herein means further that the element contains an amount of incorporated organic silver salt, if any, at a level less than 20% of the amount of incorporated silver halide on a mole silver (organic silver salt) per mole silver (silver halide) basis. Examples of such organic silver salts include silver behenate, silver 4-hydroxy benzotriazole, silver benzotriazole, and silver 5-methyl benzotriazole. Other examples of such salts are disclosed in U.S. Pat. No. 5,032,499 at column 30, line 9 through column 31, line 37, the disclosure of which is incorporated herein by reference.

The term "methine-dye" in the present specification means a dye having two methine carbon atoms, where these two carbon atoms are joined by a double bond, and where these doubly bonded carbon atoms are integral to the chromophoric atoms of the methine-dye. The methine-dye moieties of the present specification have the structure:

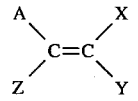

(II)

where X, Y, Z, and A are substituents. These substituents do not join to form an aromatic ring system.

Element Layer Structure

A suitable Integral Layer Structure for elements of the present invention generally consists of a (1) dimensionally stable support of transparent or reflection

| Integral Layer Structure |
|---|
| Protective Overcoat Layer |
| Imaging Layer(s) |
| Stripping Layer |
| Dye-Receiving Layer(s) |
| Support |

material, (2) a receiver layer to which the diffusible dyes migrate under thermal activation, (3) optionally a stripping layer, (4) one or more imaging layer(s) (comprising silver halide and diffusible-dye releasing couplers) in which the light image is captured and amplified during conventional aqueous color development, and (5) a protective overcoat. This structure is illustrated in Table 1. Stripping layers in such structures may be omitted. The imaging layer(s) and overcoat layer comprise a "donor" element. The support and dye-receiving layer comprises a "receiving" element.

Another suitable structure for elements of the present invention is the non-integral Laminate Layer Structure illustrated below, where separate donor and receiver elements are shown. The donor element comprises a support, one or more imaging layers, and optionally a protective overcoat layer. Such a donor element, subsequent to aqueous development and drying, is laminated to a suitable receiver element and heated to effect image dye transfer. Suitable receiver elements generally comprise a support and a dye-receiving layer or layers.

| Laminate Layer Structure |
|---|
| Receiver Support |
| Dye-Receiving Layer(s) |
| Protective Overcoat Layer |
| Diffusible-Dye Releasing (Imaging) Layer(s) |
| Donor Support |

Support

The photographic elements can be coated on a variety of supports such as described in Research Disclosure, Section XVII and the references described therein. Typical of useful paper supports are those which are partially acetylated or coated with baryta and/or a polyolefin, particularly a polymer of an α-olefin containing 2 to 10 carbon atoms, such as polyethylene, polypropylene, copolymers of ethylene and propylene and the like. Preferred paper-base supports also comprise auxiliary pigments such as titania (anitase, rhutile) to improve the reflectivity to visible light of said support. Suitable supports of the present invention can contain optical brighteners (see Research Disclosure, Section V). 0 Suitable supports also include transparent film supports. In the integral layer structure illustrated in Table 1 and in the receiver element illustrated in Table 2, said support and receiver support may each independently be a transparent film support or an opaque reflection support, depending on the desired application and use of the resulting print material (receiver element). In the donor element illustrated in Table 2, said donor support preferably is an opaque reflection support. Said donor support may be a transparent film support.

Dye-Receiving Layers

The dye-receiving layer or layers to which the formed dye image is transferred according to the present invention may be coated on the photographic element between the emulsion layer and support as is illustrated in Table 1, or may be in a separate dye-receiving element which is brought into contact with the photographic element during the dye transfer step, as is illustrated in Table 2. If present in a separate receiving element, the dye receiving layer may be coated or laminated to a support such as those described for the photographic element support above, or may be self-supporting. In a preferred embodiment of the invention, the dye-receiving layer is present between the support and silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-co-acrylonitrile)s, poly(caprolactone)s and mixtures thereof. The dye receiving layer may be present in any amount which is effective for the intended purpose. In general, good results have been obtained with amounts of from about 1 to about 10 g/m$^2$ when coated on a support. In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylene glycol, 2,2-bis(4-oxyphenyl-)propane, bis(4-oxyphenyl)methane, 1,1-bis(4-oxyphenyl)ethane, 1,1-bis(oxyphenyl)butane, 1,1-bisphenol-A polycarbonate having a number average molecular weight of at least about 25,000 is used. Examples of preferred polycarbonates include General Electric LEXAN® Polycarbonate Resin and Bayer AG MACROLON® 5700 . Further, a thermal dye transfer overcoat polymer as described in U.S. Pat. No. 4,775,657 may also be used.

Heating times of from about 10 seconds to 30 minutes at temperatures of from about 50° to 200° C. (more preferably 75° to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75 to 190° C. Particularly useful methods of heating and stripping are described by Texter et al. in U.S. Pat. No. 5,164,280 and by Lynch and Texter in U.S. Pat. No. 5,294,514, the disclosures of which are incorporated herein in their entireties.

Stripping Layers

Stripping layers are included in preferred embodiments to facilitate the mechanical separation of receiver layers and mordant layers from donor layers and diffusible dye forming layers. Stripping layers are usually coated between a dye receiving layer and one or more diffusible dye-forming layers. Stripping layers may be formulated essentially with any material that is easily coatable, that will maintain dimensional inegrity for a sufficient length of time so that a suitable image may be transferred by dye diffusion there through with sufficiently adequate density and sharpness, and that will facilitate the separation of donor and receiver components of the photographic element under suitable stripping conditions. Said dimensional stability must be maintained during storage and during the development and dye forming process. In preferred embodiments this dimensional stability is maintained during all wet or aqueous processing steps and during subsequent drying. Various stripping polymers and stripping agents may be used alone and in combination in order to achieve the desired strippability in particular processes with particular photographic elements. The desired strippability in a given process is that which results in clean separation between the image receiving layer(s) and the emulsion and diffusible dye forming layers adhering to the image receiving layer. Good results have in general been obtained with stripping agents coated at level of 3 mg/m$^2$ to about 500 mg/m$^2$. The particular amount to be employed will vary, of course, depending on the particular stripping agent employed and the particular photographic element used, and the particular process employed.

Perfluoronated stripping agents have been disclosed by Bishop et al. in U.S. Pat. No. 4,459,346, the disclosure of which is incorporated herein in its entirety by reference. In a preferred embodiment of our invention, the stripping layer comprises stripping agents of the following formula:

$$CF_3(CF_2)_n-SO_2-\overset{\overset{\displaystyle R_1}{|}}{N}-CH_2R_2$$

wherein $R_1$ is an alkyl or substituted alkyl group having from 1 to about 6 carbon atoms or an aryl or substituted aryl group having from about 6 to about 10 carbon atoms; $R_2$ is $$-\overset{\overset{\displaystyle O}{||}}{C}-O-(CH_2CH_2O)_x-R_3,$$

$$-\overset{\overset{\displaystyle O}{||}}{C}-O-(CH_2)_y-R_3,$$

$$-CH_2-O-(CH_2CH_2O)_z-R_3;$$

$R_3$ is H or $H_1$/ n id an integer of from about 4 to about 19; x and y each represents an integer from about 2 to about 50, and z each represents an integer of from 1 to about 50. In another preferred embodiment, $R_1$ is ethyl, $R_2$ is $$-\overset{\overset{\displaystyle O}{||}}{C}-O-(CH_2CH_2O)_x-H,$$

n is about 8, and x is about 25 to 50. In another preferred embodiment, $R_1$ is ethyl, $R_2$ is $$-\overset{\overset{\displaystyle O}{||}}{C}-O-(CH_2)_y-H,$$

n is about 8, and y is about 25 to 50. In another preferred embodiment, $R_1$ is ethyl, $R_2$ is $-CH_2O(CH_2CH_2O)_zH$, n is 8 and z is 1 to about 30.

If the process of this invention is used to produce a transparency element for use in high magnification projection, it is desirable. to maintain sharpness and to minimize the thickness of the diffusion path. This minimization is achieved in part by using a stripping layer that does not swell appreciably and which is as thin as possible. These requirements are met by the perfluoronated stripping agents herein described. These agents provide clean stripping and do not materially alter the surface properties at the stripping interface. These perfluoronated stripping agents also provide for a stripping layer with weak dry adhesion. A strong dry adhesion makes separation of substantially dry elements difficult.

Preferred stripping agents useful in the process of this invention include the following compounds:

$$C_8F_{17}SO_2-\overset{\overset{\displaystyle CH_2CH_3}{|}}{N}-CH_2-\underset{\underset{\displaystyle O}{||}}{C}-O-(CH_2CH_2O)_{40}-H$$

SA1

(Fluorad ® FC-431[3M Company])

$$C_8F_{17}SO_2-\overset{\overset{\displaystyle CH_2CH_3}{|}}{N}-CH_2-\underset{\underset{\displaystyle O}{||}}{C}-O-(CH_2)_{40}-H$$

SA2

(Fluorad ® FC-432[3M Company])

$$C_8F_{17}SO_2-\overset{\overset{\displaystyle CH_2CH_3}{|}}{N}-(CH_2CH_2O)_{z=30}-H$$

SA3

(Fluorad ® FC-170[3M Company])

Imaging Layers

The silver halide emulsion employed in the elements of this invention can be either negative working or positive working. Examples of suitable emulsions and their preparation are described in Research Disclosure, Sections I and II and the publication cited therein. Examples of suitable vehicles for the emulsion layers and other layers of elements of this invention are described in Research Disclosure, Section IX and the publications cited therein. The composition of said silver halide is preferably 70 mole percent or greater silver chloride, and most preferably 95 mole percent or greater silver chloride. Increasing the proportion of chloride increases the developability of said silver halide emulsions.

The photographic elements of this invention or individual layers thereof can contain, for example, brighteners (see Research Disclosure, Section V), antifoggants and stabilizers (see Research Disclosure, Section VI), antistain agents and image dye stabilizers (see Research Disclosure, Section VII, paragraphs I and J), light absorbing and scattering materials (see Research Disclosure, Section VIII), hardeners (see Research Disclosure, Section IX), plasticizers and lubricants (see Research Disclosure, Section XII) antistatic agents (see Research Disclosure, Section XIII), matting agents (see Research Disclosure, Section XVI), and development modifiers (see Research Disclosure, Section XXI), reducing agents, and electron transfer agents.

Preferred embodiments of the elements of the present invention are essentially devoid of incorporated developing agents, reducing agents, and electron transfer agents, so as to provide stability during preprocessing storage against chemical fogging.

Other preferred embodiments of the elements of the present invention are essentially devoid of interlayers containing oxidized developer scavengers of the reducing agent type, such as hydroquinones, including ballasted hydroquinones. The exclusion of such oxidized developer scavengers of the reducing agent type provides for improved stability during storage against thermal degradation of such reducing agents.

Diffusible Methine-Dye Releasing Couplers

Diffusible methine-dye releasing compounds of any type may be utilized, so long as the released diffusible methine-dye is diffusible at elevated temperature in a hydrophilic colloid such as gelatin and other hydrophilic colloids when said colloids are nominally dry (contain less than 50% by weight water). Preferred are compounds according to formula I $$Cp—L—M \quad (I)$$

wherein Cp is a coupler radical, L is a divalent linking group, and M is a methine-dye radical exhibiting selective absorption in the visible spectrum.

COUPLING RADICALS

Cp may represent a coupler moiety, capable of forming a cyan dye by coupling with an aromatic primary amine developing agent. Couplers which form cyan dyes upon reaction with oxidized color developing agents are described in such representative patents as U.S. Pat. Nos. 2,367,531, 2,423,730, 2,474,293, 2,772,162, 2,801,171, 2,895,826, 3,002,836, 3,034,892, 3,041,236, 3,419,390, 3,476,565, 3,779,763, 3,996,252, 4,124,396, 4,248,962, 4,254,212, 4,296,200, 4,333,999, 4,443,536, 4,457,559, 4,500,635, 4,526,864, and 4,874,689 and in European Patent Application No. 0 283 938 A1, the disclosures of which are incorporated by reference. Preferred coupler moieties Cpwhich form cyan dyes upon reaction with oxidized color developing agents are of the phenol type (formula C-I) or the naphthol type (formulae C-II and C-III) or of the type C-IV; the asterisk mark indicates the position of the bond to the divalent linking group L in formula (I)

C-I

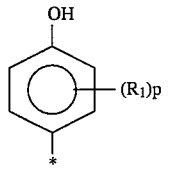

C-II

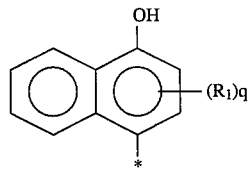

-continued

C-III

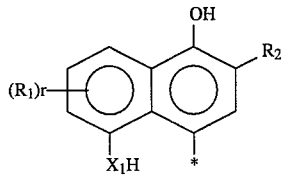

C-IV

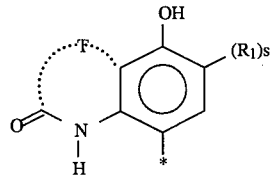

In formulae C-I, C-II, C-III, and C-IV above:

$R_1$ has 0 to 30 carbon atoms and represents a possible substituent on the phenol ring or naphthol ring. It is an alkyl group, an alkenyl group, an alkoxy group, an alkoxycarbonyl group, a halogen atom , an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group, an arylureido group, hydroxyl group, amino group, carboxyl group, sul fo group, heterocylcic group, carbonamido group, sulfonamido group, carbamoyl group, sul famoyl group, ureido group, acyloxy group, aliphatic oxy group, aliphatic thio group, aliphatic sulfonyl group, aromatic oxy group, aromatic thio group, aromatic sulfonyl group, sulfamoyl amino group, nitro group, or imido group.

$R_2$ represents —$CONR_3R_4$, —$NHCOR_3$, —NHCOOR5, NHSO2$R_5$, $NHCONR_3R_4$, or $NHSO_2R_3R_4$, $R_3$ and $R_4$ each represent a hydrogen atom, aliphatic group having 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-t-amylphenoxy-propyl, and 2,4-di-t-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_5$ represents an aliphatic goup having from 1 to 30 carbon atoms (such as methyl, ethyl, butyl, methoxyethyl, n-decyl, n-dodecyl, and n-hexadecyl), aromatic group having from 6 to 30 carbon atoms (such as phenyl, tolyl, 4-chlorophenyl, and naphthyl ) , or heterocyclic group (such as 2-pyridyl, 4-pyridyl, and 2-furyl). $R_3$ and $R_4$ may join each other to form a heterocyclic ring (such as morpholine ring, piperidine ring, and pyrrolidine ring); p is an integer form 0 to 3; q and r are integers from 0 to 4; s is an integer from 0 to 2.

$X_1$ represents an oxygen atom, sulfur atom, or R6N< group, where $R_6$ represents a hydrogen atom or monovalent group. When $R_6$ represents a monovalent group, it includes, for example, an aliphatic group having from 1 to 30 carbon atoms (such as methyl, ethyl, butyl, methoxyethyl, and benzyl ) , aromatic group having from 6 to 30 carbon atoms (such as phenyl and tolyl), heterocyclic group having from 2 to 30 carbon atoms (such as 2-pyridyl and 2-pyrimidyl), carbonamido group having from 1 to 30 carbon atoms (such as formamido, acetamido, N-methylacetamido, toluenesulfonamido, and 4-chlorobenzenesulfonamido), imido group having from 4 to 30 carbon atoms (such as succinimido), —$OR_7$, —$SR_7$, —$COR_7$. —$CONR_7R_8$, —$COCOR_7$, —$COCOR_7R_8$, —$COOR_7$, —$COCOOR_9$, —$SO_2R_9$, —$SO_2OR_9$, —$SO_2NR_7R_8$, or —$NR_7R_8$. $R_7$ and $R_8$, which may be the same or different, each represent a hydrogen atom, aliphatic group having from 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di- -amylphenoxypropyl, and 2,4-di-t-amylphenoxybutyl), aromatic group having from 6 to 30 carbon atoms ( such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_7$ and $R_8$ may join each other to form a heterocyclic ring (such as morpholine group and piperidine group). $R_9$ may include, for example, those substituents (excluding a hydrogen atom) exemplified for $R_7$ and $R_8$.

T represents a group of atoms required to form a 5-, 6-, or 7-membered ring by connecting with the carbon atoms. It represents, for example

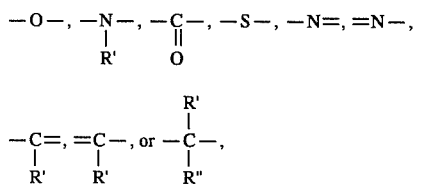

or a combination thereof. In the formulae above, R' and R" each represent a hydrogen atom, alkyl group, aryl group, halogen atom, alkyloxy group, alkyloxycarbonyl group, arylcarbonyl group, alkylcarbamoyl group, arylcarbamoyl group or cyano group.

The preferred substituent groups in the present invention are exemplified in the following:

$R_1$ includes a halogen atom (such as fluorine, chlorine, and bromine), aliphatic group (such as methyl, ethyl, and isopropyl), carbonamido group (such as acetamido and benzamido), and sulfonamido (such as methanesulfonamido and toluenesulfonamido).

$R_2$ includes —$CONR_3R_4$ (such as carbamoyl, ethylcarbamoyl, morpholinocarbonyl, dodeCylcarbamoyl, hexadecylcarbamoyl, decyloxypropyl, dodecyloxypropyl, 2,4-di-tert-amylphenoxypropyl, and 2,4-di-t-amylphenoxybutyl). $X_1$ includes $R_6N<$, wherein $R_6$ is preferably —$COR_7$ (such as formyl, acetyl, trifluoroacetyl, benzoyl, pentafluorobenzoyl, and p-chlorobenzoyl) , —$COOR_9$ (such as methoxycarbonyl, ethoxycarbonyl, butoxycarbonyl, dodecyloxycarbonyl, methoxyethoxycarbonyl, and phenoxycarbonyl), —$SO_2R_9$ (such as methanesulfonyl, ethanesulfonyl, butanesulfonyl, hexadecanesulfonyl, benzenesulfonyl, toluenesulfonyl, and p-chlorobenzensulfonyl), —$CONR_7R_8$ (such as N,N-dimethyl carbamoyl, N,N-diethylcarbamoyl, N,N-dimethylcarbamoyl, N,N-diethylcarbamoyl, N,N-dibutylcarbamoyl, morpholinocarbonyl, piperidinocarbonyl, 4-cyanophenylcarbamoyl, 3,4-dichlorophenylcarbamoyl, and 4-methanesulfonylphenylcarbamoyl, and dibutylcarbamoyl), and —$SO_2NR_7R_8$ (such as N,N-dimethylsulfamoyl, N,N-diethylsulfamoyl, and N,N-dipropylsulfamoyl). Particularly preferred examples of $R_6$ are those groups represented by —$COR_7$, —$COOR_9$, and —$SO_2R_9$.

$R_1$ may be substituted. Preferred substituents are aryl groups (such as phenyl), nitro group, hydroxy group, cyano group, sulfo group, an alkoxy group (such as methoxy), an aryloxy group (such as phenoxy), an acyloxy group (such as acetoxy), an acylamino group (such as aetylamino), an alkylsufonamido group (such as methanesulfonamido), an alkylsulfamoyl group (such as fluorine atom, chlorine atom, bromine atom), carboxyl group, an alkylcarbamoyl group (such as methylcarbamoyl), an alkoxycarbonyl group (such as methoxycarbonyl), an alkylsulfonyl group (such as methylsulfonyl), an alkylthio group (such as β-carboxyethylthio), etc. In the case that said group is substituted by two or more of said substituents, these substituents may be the same or different.

Cp may represent a coupler moiety, capable of forming a magenta dye by coupling with an aromatic primary amine developing agent. Couplers which form magenta dyes upon reaction with oxidized color developing agents are described in such representative patents and publications as U.S. Pat. Nos. 1,969,479, 2,311,082, 2,343,703, 2,369,489, 2,600,788, 2,908,573, 3,061,432, 3,062,653, 3,152,896, 3,519,429, 3,615,506, 3,725,067, 4,120,723, 4,500,630, 4,522,916, 4,540,654, 4,581,326, and 4,874,689, and European Patent Publication Nos. 0 170 164, 0 177 765, 0 283 938 A1, and 0 316 955 A3, the disclosures of which are incorporated by reference. Preferred magenta couplers include pyrazolones, pyrazolotriazole, and pyrazolobenzimidazole compounds which can form heat transferable dyes upon reaction with oxidized color developing agent. Preferred coupler moieties Cp which form magenta dyes upon reaction with oxidized color developing agents are of the pyrazolotriazole-type and imidazopyrazole-type (formulae M-I to M-VII); the asterisk mark indicates the position of the bond to the divalent linking group L in formula (I)

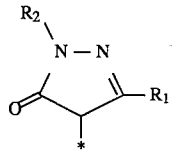

M-I

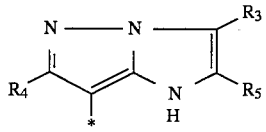

M-II

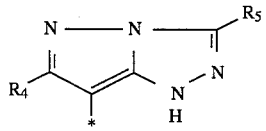

M-III

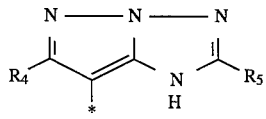

M-IV

-continued

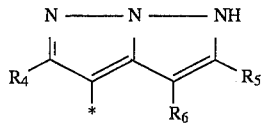

M-V

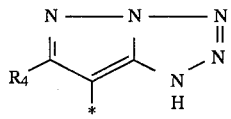

M-VI

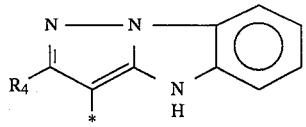

M-VII

In formulae M-I, M-II, M-III, M-IV, M-V, M-VI, and MVII above:

$R_1$ and $R_2$ each independently represent a conventional substituent which is well known as a substituent on the 1-position or on the 3-position of a 2-pyrazolin-5-one coupler, such as an alkyl group, a substituted alkyl group (such as a halo-alkyl group, e.g., fluoroalkyl, or cyanoalkyl, or benzyl-alkyl), an aryl group or a substituted arylgroup (e.g., methyl or ethyl substituted), an alkoxy group (such as methoxy or ethoxy), an aryloxy group (such as phenyloxy), an alkoxycarbonyl group (such as methoxy carbonyl), an acylamino group (such as acetylamino), a carbamoyl group, an alkylcarbamoyl group (such as methylcarbamoyl or ethylcarbamoyl), a dialkylcarbamoyl group (such as dimethylcarbamoyl), an arylcarbamoyl group (such as phenylcarbamoyl), an alkylsulfonyl group (such as methylsulfonyl), an arylsulfonyl group (such as phenylsulfonyl), an alkylsulfonamido group (such as methanesulfonamido), an arylsulfonamido group (such as phenylSulfonamido), a sulfamoyl group, an alkylsulfamoyl group (such as ethylsulfamoyl), a dialkylsulfamoyl group (such as dimethylsulfamoyl), an arylsulfamoyl group, an alkylthio group (such as methylthio), an arylthio group (such as phenylthio), cyano group, nitro group, a halogen atom (such as fluorine atom, chlorine atom, bromine atom), etc. In case said group is substitutedby two or more of said substituents, these may be the same or different. The most preferred substituents are a halogen atom, an alkyl group, an alkoxy group, an alkoxycarbonyl group, and the cyano group.

$R_3$, $R_4$, $R_5$, and $R_6$ are each independently a hydrogen atom or hydroxyl group, or represent an unsubstituted or substituted alkyl group (preferably having from 1 to 20 carbon atoms, such as methyl, propyl, t-butyl, or trifluoromethyl, tridecyl), an aryl group (preferably having from 6 to 20 carbon atoms, such as phenyl, 4-t-butylphenyl, 2,4-di-t-amylphenyl, or 4-methoxyphenyl), a heterocyclic group (such as 2-furyl, 2-thienyl, 2-pyrimidinyl, or 2-benzthiazolyl), an alkylamino group (preferably having from 1 to 20 carbon atoms, such as methylamino, diethylamino, t-butylamino), an acylamino group (preferably having from 2 to 20 carbon atoms, such as acetylamino, propylamido, benzamido), an anilino group (such as phenylamino, 2-chloroanilino), an alkoxycarbonyl group (preferably having from 2 to 20 carbon atoms, such as methoxycarbonyl, butoxycarbonyl, 2-ethylhexyloxycarbonyl), an alkylcarbonyl group (preferably having from 2 to 20 carbon atoms, such as acetyl, butylcarbonyl, cyclohexylcarbonyl), an arylcarbonyl group (preferably having from 7 to 20 carbon atoms, such as benzoyl, or 4--butylbenzoyl), an alkylthio group (preferably having from 1 to 20 carbon atoms, such as methylthio, octylthio, 2-phenoxyethylthio), an arylthio group (preferably having from 6 to 20 carbon atoms, such as phenylthio, 2-butoxy-5-t-octylphenylthio), a carbamoyl group (preferably having from 1 to 20 carbon atoms, such as N-ethylcarbamoyl, N,N-dibutylcarbamoyl, N-methyl-N-butylcarbamoyl), a sulfamoyl group (preferably $NH_2SO_2$ and a group having from 1 to 20 carbon atoms, such as N-ethylsulfamoyl, N,N-diethylsulfamoyl, N,N-dipropylsulfamoyl), or an alkyl sulfonamido group (preferably having from 6 to 20 carbon atoms, such as benzenesulfonamido, p-toluenesulfonamido).

Cp may represent a coupler moiety, capable of forming a yellow dye by coupling with an aromatic primary amine developing agent. Couplers which form yellow dyes upon reaction with oxidized color developing agent are described in such representative as U.S. Pat. Nos. 2,298,443, 2,875,057, 2,407,210, 3,265,506, 3,384,657, 3,408,194, 3,415,652, 3,447,928, 3,542,840, 4,046,575, 3,894,875, 4,095,983, 4,182,630, 4,203,768, 4,221,860, 4,326,024, 4,401,752, 4,443,536, 4,529,691, 4,587,205, 4,587,207 and 4,617,256, and in European Patent Applications 0 259 864 A2, 0 283 938 A1 , and 0 316 955 A3, the disclosures of which are incorporated by reference. Preferred yellow dye image forming couplers are acylacetamides, such as benzoylacetanilides and pivalylacetanilides, which can form heat transferable dyes upon reaction with oxidized color developing agent. Preferred coupler moieties Cp which form yellow dyes upon reaction with oxidized color developing agents are of the acylacetanilide type (formula Y-I) and benzoylacetanilide type (formulae Y-II and Y-III); the asterisk mark indicates the position of the bond to the divalent linking group L in formula (I).

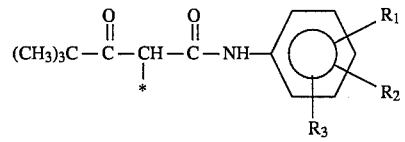

Y-I

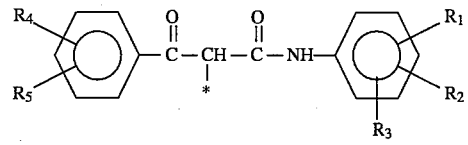

Y-II

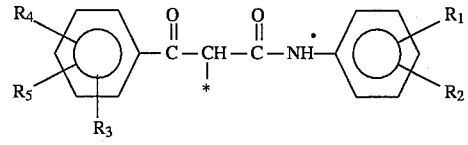

Y-III

In formulae Y-I, Y-II, and Y-III above:

$R_1$, $R_2$, $R_3$, $R_4$, and $R_5$ each independently represents a hydrogen atom or a substituent which is conventional and well known in a yellow coupler group, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, or thiocyano group.

Cp may represent a coupler moiety, capable of forming a colorless product by coupling with an aromatic primary amine developing agent. Couplers which form colorless products upon reaction with oxidized color developing agent are described in such representative as U.S. Pat. Nos. 3,632,345, 3,928,041, 3,958,993, and 3,961,959, and in United Kingdom Patent No. 861,138, the disclosures of which are incorporated herein by reference. Preferred colorless product forming couplers are cyclic carbonyl containing compounds and have the coupling-off group attached to the carbon atom in the position with respect to the carbonyl group. Preferred coupling moieties Cp which form colorless products upon reaction with oxidized color developing agents are depicted in formulae W-I–W-IV; the asterisk mark indicates the position of the bond to the divalent linking group L in formula (I):

W-I

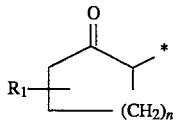

W-II

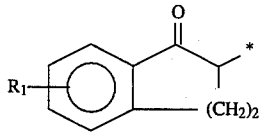

W-III

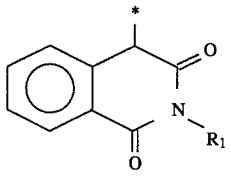

W-IV

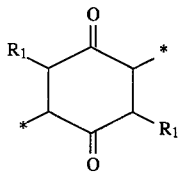

In formulae W-I - W-IV above: $R_1$ represents a ballast group; n is 1 or 2.

Cp may represent a coupler moiety, capable of forming a black dye or a brown dye by coupling with an aromatic primary amine developing agent. Couplers which form black and brown dyes upon reaction with oxidized color developing agent are described in such representative as U.S. Pat. Nos. 1,939,231, 2,181,944, and 2,333,106, and 4,126,461, and German OLS Nos. 2,644,194 and 2,650,764, which are incorporated herein by reference. Preferred black and brown dye forming couplers are resorcinols or m-aminophenols and have the coupling-off group attached in the para-position with respect to the hydroxyl group Preferred coupling moieties Cpwhich form black dyes and brown dyes upon reaction with oxidized color developing agents are depicted in formulae B-I–B-III; the asterisk mark indicates the position of the bond to the divalent linking group L in formula (I):

B-I

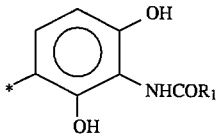

B-II

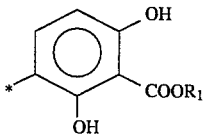

B-III

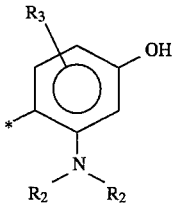

In formulae B-I–B-III above: $R_1$ is alkyl of 3 to 20 carbon atoms, phenyl, or phenyl substituted with hydroxy, halo, amino, alkyl of 1 to 20 carbon atoms or alkoxy of 1 to 20 carbon atoms; each $R_2$ is independently hydrogen, halogen, alkyl of 1 to 20 carbon atoms, alkenyl of 1 to 20 carbon atoms, or aryl of 6 to 20 carbon atoms; $R_3$ is one or more halogen, alkyl of 1 to 20 carbon atoms, alkoxy of 1 to 20 carbon atoms, any other monovalent group.

Any of the foregoing coupler radicals may be ballasted by attachment to a polymer at some position other than the coupling position of said radicals.

LINKING GROUPS

The linking group may be any divalent group that attaches to the coupling position of Cp and to the M moiety such that the coupling-off group, comprising the linking group L and the mehine-dye M, —L—M, is released from the coupler upon reaction of oxidized developer with the coupling moiety. In certain preferred embodiments of the present invention, the divalent linking group L is such that the M moiety is subsequently released from the coupling-off group. Linking groups suitable for the present invention have been described in U.S. Pat. Nos. 4,248,962, 4,409,323, and 4,840,884, the disclosures of which are incorporated herein by reference. The group L can contain moieties and substituents which will permit control of one or more of the rate of reaction of Cp with oxidized color developing agent, the rate of diffusion of the coupling off group, and the rate of release of Dye.

Preferred linking groups include the following:

L-1

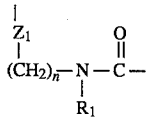

where n is 1–4, n is preferably 2 or 3;

L-2
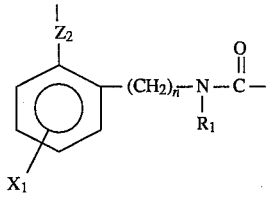
L-3
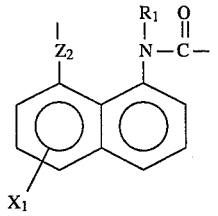
where n is 0 to 1;
L-4
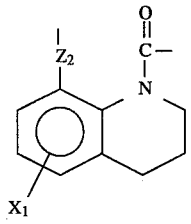
L-5
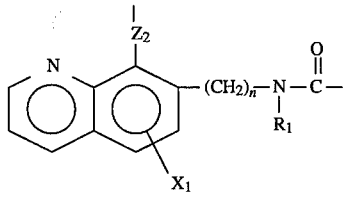
where n is 0 or 1;
L-6
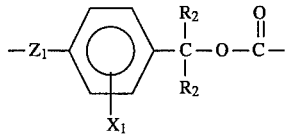
L-7
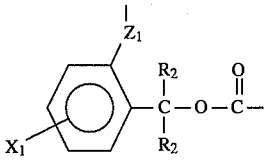
L-8
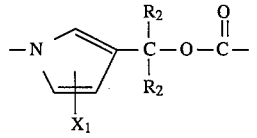
-continued
L-9
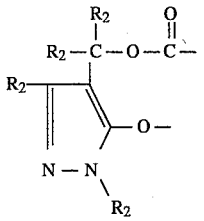
L-10
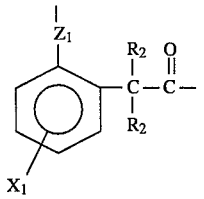
L-11
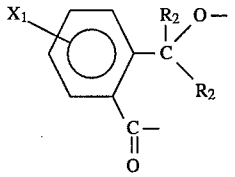
L-12
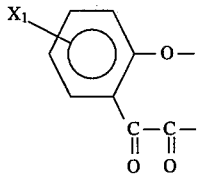
L-13
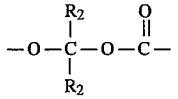
L-14
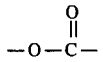
wherein
$Z_1$ is
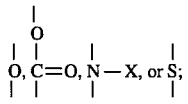
where X is a substituent;
$Z_2$ is
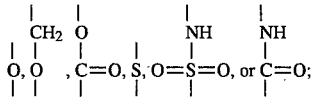
$R_1$ is hydrogen, alkyl of 1 to 20 carbon atoms, preferably lower alkyl of 1 to 4 carbon atoms, or aryl of 6 to 30 carbon atoms, preferably aryl of 6 to 10 carbon atoms;

each $R_2$ independently is hydrogen, alkyl of 1 to 25 carbon atoms, preferably lower alkyl of 1 to 4 carbon atoms, cycloalkyl, substituted cycloalkyl, or aryl of 6 to 30 carbon atoms, preferably aryl of 6 to 10 carbon atoms;

$X_1$ is hydrogen, cyano, fluoro, chloro, bromo, iodo, nitro, alkyl of 1 to 20 carbon atoms, aryloxy, alkoxycarbonyl, hydroxy, sulfonyl, acyl, alkoxy, sulfo, $—OR_2$, $—COOR_2$, $—CONHR_2$, $—NHCOR_2$, $—NHSO_2R_2$, $—SO_2NHR_2$, or $—SO_2R_2$.

The following are suitable examples of these preferred linking groups:

LK-1

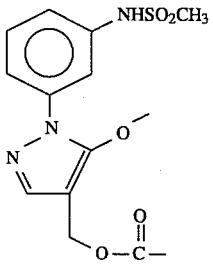

LK-2

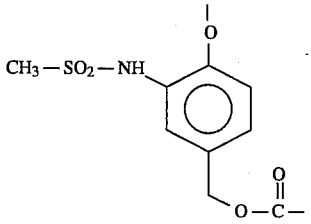

LK-3

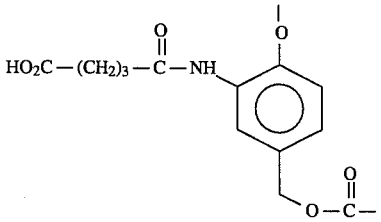

LK-4

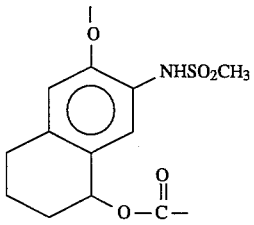

LK-5

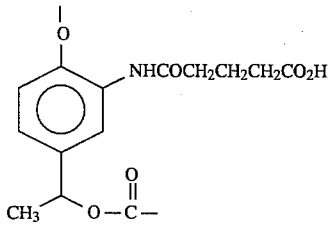

-continued

LK-6

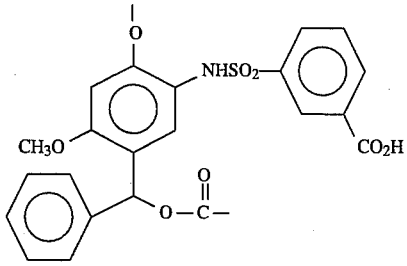

LK-7

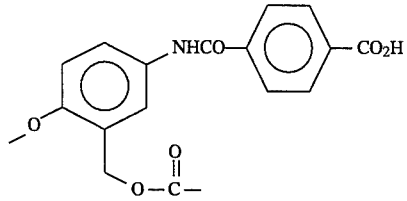

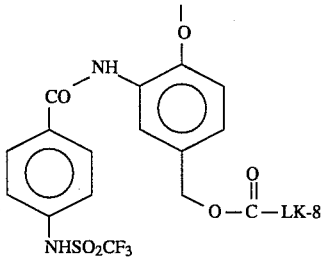

DYE RADICALS

The mehine-dye moiety M in coupler structure (I) may be any diffusible mehine-dye or diffusible mehine-dye precursor, including leuco mehine-dye or shifted mehine-dye.

Suitable examples of mehine-dye radicals are given by structure (III):

(III)

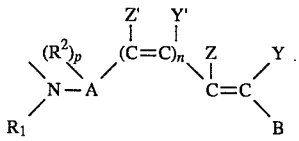

wherein $R^1$ is hydrogen or unsubstituted alkyl or aryl (including heteroaryl) group;

A is a substituted or unsubstituted aryl (including heteroaryl) ring;

each $R^2$ is independently a substituted or unsubstituted alkyl group which may form a ring with Z' or Z when n=0;

p is an integer from 0 to 3;

each Z, Z', and Y' is independently hydrogen or a substituent;

Y is an electron withdrawing group;

n is 0, 1, or 2; and

B is a heterocycle having the formula (IV):

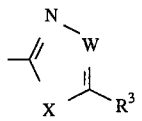

(IV)

wherein:

X is O, S, or N($R^5$) where $R^5$ is hydrogen or alkyl;

W is N or C($R^4$) where $R^4$ is hydrogen or a substituent;

$R^3$ is a substituent linked to the heterocycle by a carbon or nitrogen atom of the substituent;

provided that $R^3$ and $R^4$ may be linked to form a ring. In preferred embodiments, when Z is hydrogen and X is oxygen, neither $R^3$ nor $R^4$ nor a ring formed by them contains a substituent having a Hammett's sigma(para) value of 0.23 or more. Such a limitation imparts improved stability of the chromophore against nucleophilic attack.

Methine-dye radicals having a bond attached to a nitrogen atom as the point of attachment to the linking group L are preferred over radicals having oxygen as the point of attachment, because the resulting NH group is less hydrophilic and will tend to coordinate less water of solvation than does the OH group.

Methine-dye radicals having a bond attached to a nitrogen atom as the point of attachment to the linking group L are preferred over radicals having oxygen as the point of attachment, because the resulting NH group is less polar and will tend to offer less of an impediment to diffusion transfer through hydorphilic binder than will the OH group.

In a preferred embodiment of the elements of the present invention having mehine-dye releasing couplers according to structure (I), Cp—L—M, methine-dye radicals having a bond attached to an oxygen as the point of attachment to the linking group L are absent. Elements devoid of such oxygen attachments avoid the consequences of hydroxy group interactions between the diffusing methine-dye and polar functional groups in the hydrophilic binder.

The methine-dye radicals of the elements of the present invention may or may not be attached to the linking group L or to the coupler radical Cp of general structure (I) through a chromophoric atom, such as nitrogen or oxygen. Attachment through a chromophoric atom often provides benficial hue shifting, so that the final hue is not realized until after the dye radical separates from the coupler and linking group. Attachment through a non-chromophoric atom often imparts improved storage stability, and such attachments are preferred when hue shifting is not a significant concern and it is desired to design the linking and release chemistry without significantly affecting the dye hue before or after release.

Methods for synthesizing methine-dyes are disclosed in U.S. Pat. Nos. 2,798,090, 2,889,335, 3,013,013, 3,247,211, 3,661,899, 3,879,434, 3,917,604, 4,006,178, 4,180,663, and 4,281,115, the disclosures of which are incorporated herein in their entirety for all they disclose about methine-dyes. General schemes for synthesizing methine-dyes are described by P. Gregory (pp. 36–40) and by L. Shuttleworth and M. A. Weaver (pp. 119–128) in The Chemistry and Application of Dyes, edited by D. R. Waring and G. Hallas, and published by Plenum Press of New York, ©1990.

Examples of methine-dye suitable for the elements of the present invention include the following; the asterisk denotes the point of attachment of the methine-dye to the divalent linking group L:

DC-1

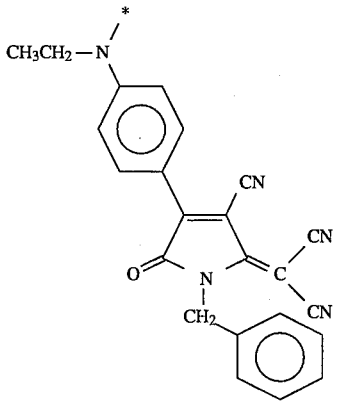

DC-2

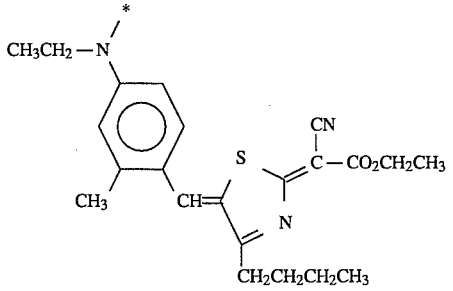

-continued
DC-3
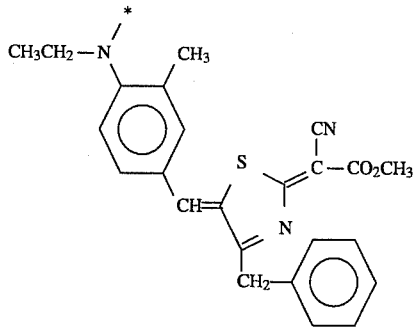
DC-4
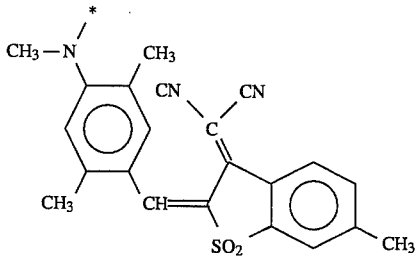
DC-5
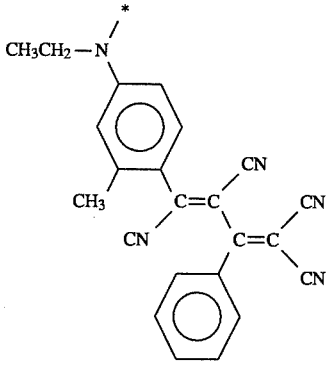
DC-6
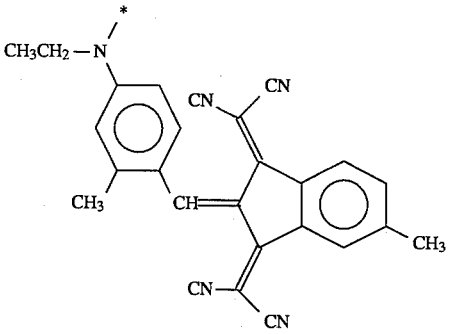
DC-7
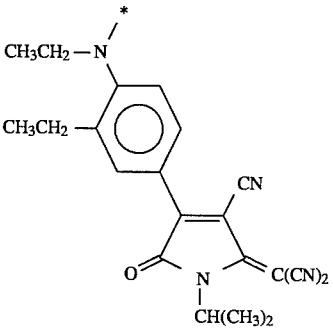

-continued
DC-8
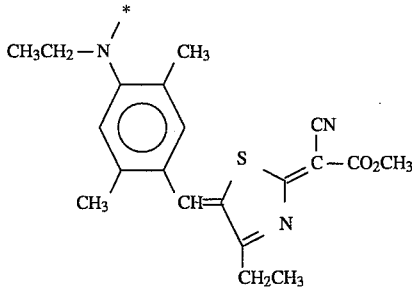
DC-9
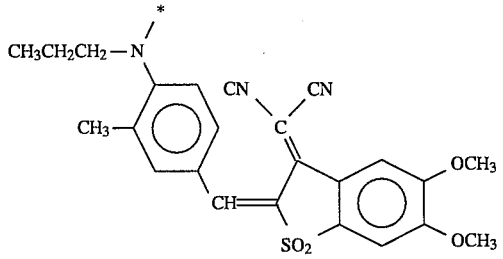
DM-1
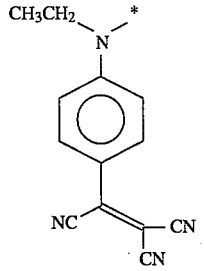
DM-2
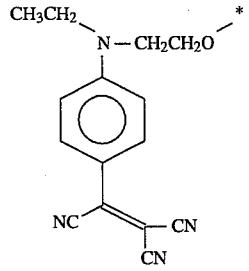
DM-3
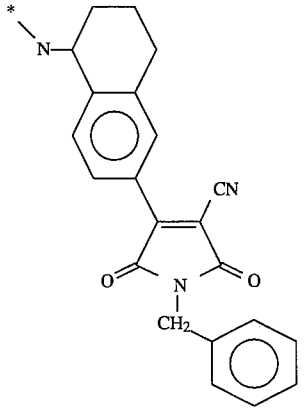

-continued
DM-4
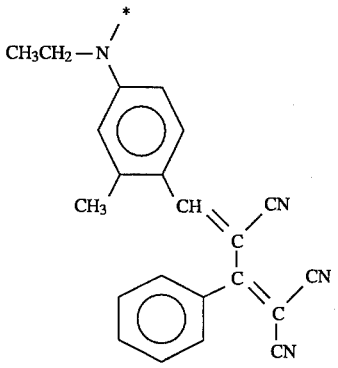
DM-5
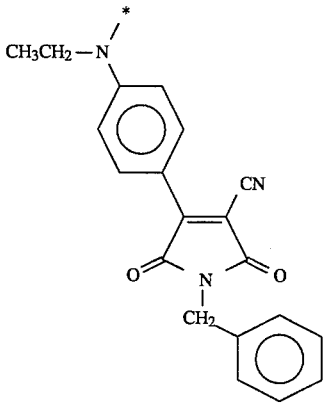
DM-6
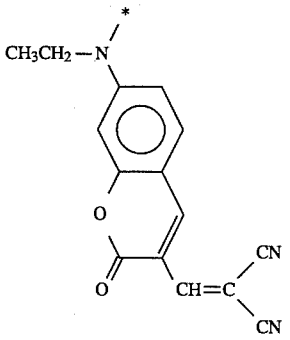
DM-7
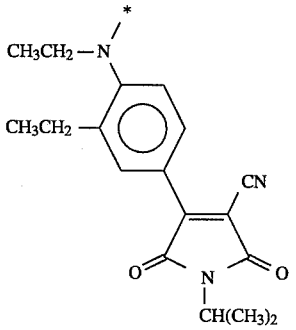

-continued
DM-8
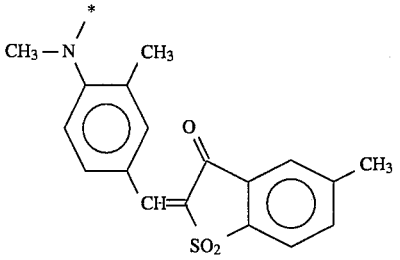
DM-9
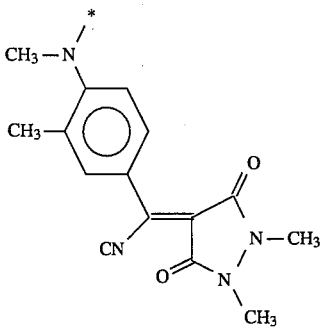
DM-10
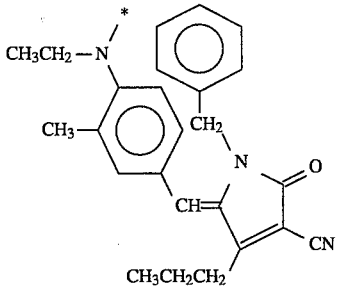
DM-11
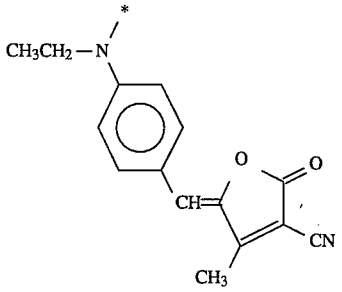
DM-12
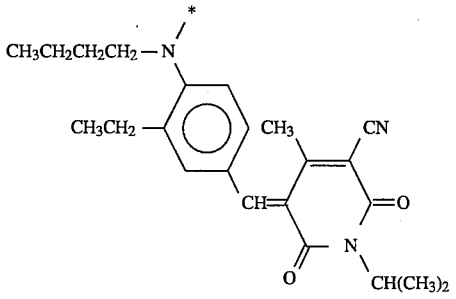
DY-1
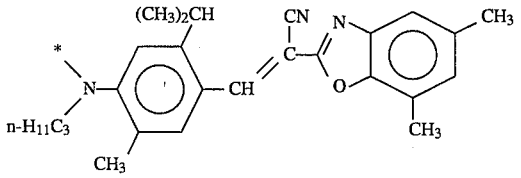

-continued
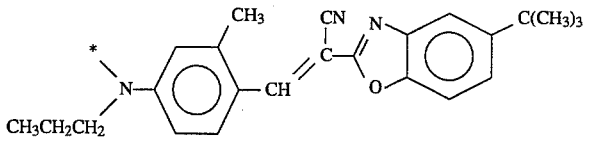
DY-2
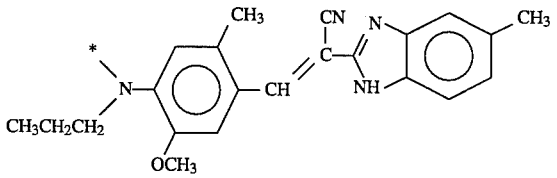
DY-3
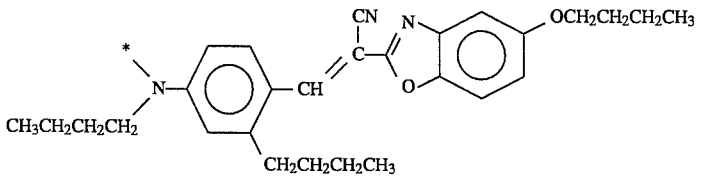
DY-4
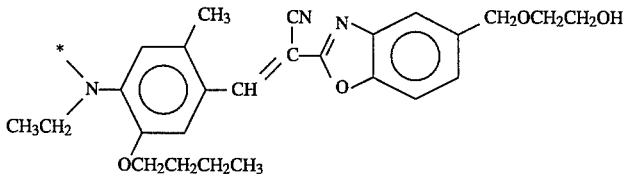
DY-5
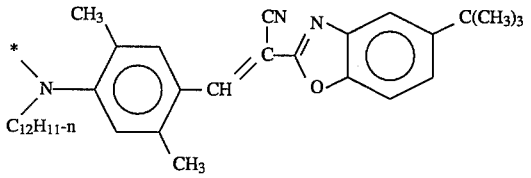
DY-6
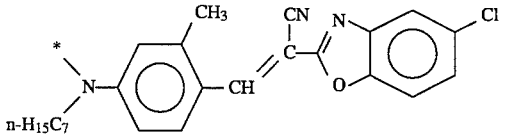
DY-7
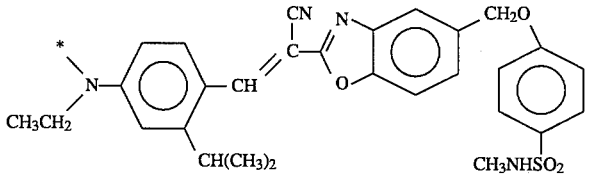
DY-8
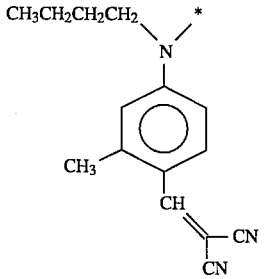
DY-9

-continued
DY-10
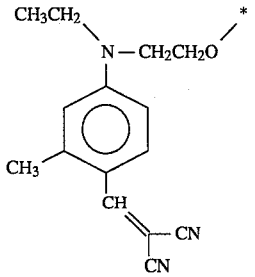
DY-11
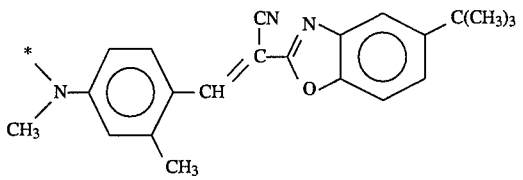
DY-12
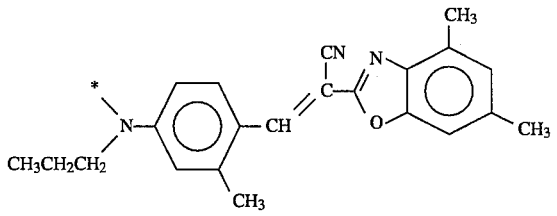
DY-13
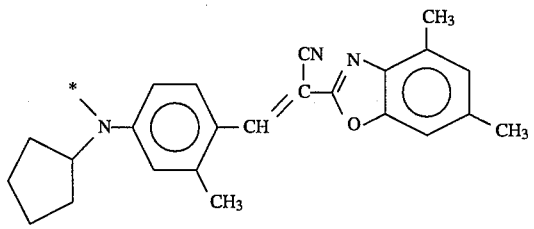
DY-14
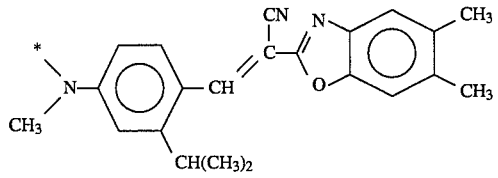
DY-15
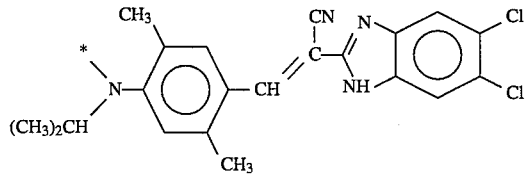
DY-16
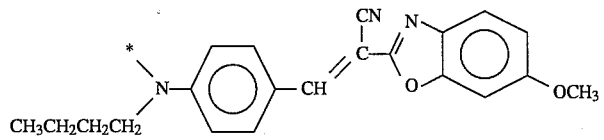
DY-17
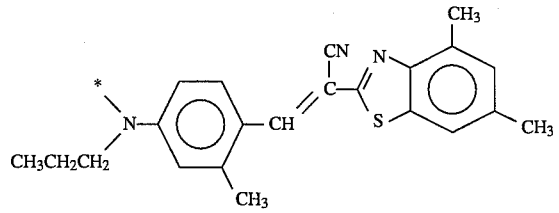

-continued

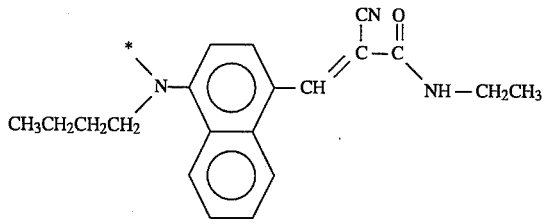

DY-18

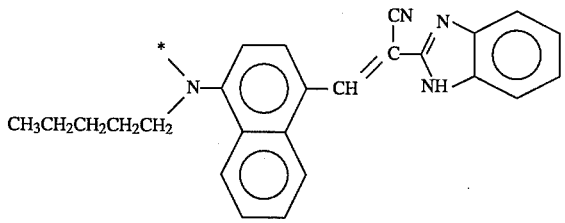

DY-19

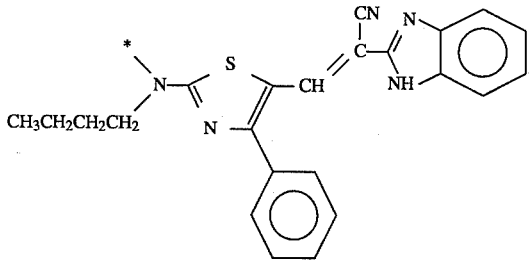

DY-20

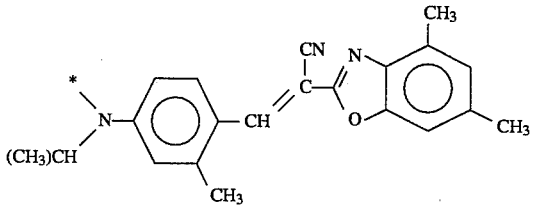

DY-21

Example couplers of the present invention are exemplified by compounds I-1 through 1–64 in copending, commonly assigned, simultaneously filed U.S. application Ser. No. 8/250,774, Photographic Element Containing A High Dye-Yield Coupler witha Methine Dye Chromophore, of Mooberry et al., the disclosure of which is incorporated herein by reference for all it discloses about methine-dye releasing couplers and photographic elements.

Thermal Solvents

Thermal solvents may be added to any layer(s) of the photographic element, including interlayers, imaging layers, and receiving layer(s), in order to facilitate transfer of dye to said receiving layer(s). Suitable thermal solvents have the structure V,

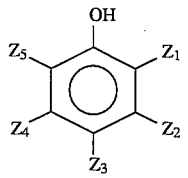

(V)

wherein (a) $Z_1$, $Z_2$, $Z_3$, $Z_4$, and $Z_5$ are substituents, the Hammet sigma parameters of $Z_2$, $Z_3$, and $Z_4$ sum to give a total, Σ, of at least −0.28 and less than 1.53;

(b) the calculated logP for V is greater than 3 and less than 10.

Examples of thermal solvents include 3-hydroxy benzoates, 4-hydroxy benzoates, 3-hydroxy benzamides, 4-hydroxy benzamides, 3-hydroxyphenyl acetamides, and 4-hydroxyphenyl aceramides. In a given layer, said thermal solvent is generally added at 1 to 300% by weight of binder in said layer. Preferably, said thermal solvent is generally added at 50 to 120% by weight of binder in said layer.

Preferred examples of said thermal solvents include aryl and alkyl esters of 3-hydroxy benzoic acid and of 4-hydroxy benzoic acid. Examples of such thermal solvents are listed on pages 27 and 28 of commonly assigned U.S. Application Ser. No. 07/993,580 of Texter et al., filed Dec. 21, 1992 as Dye Releasing Couplers for Heat Image Separation Systems, now U.S. Pat. No. 5,356,750, beginning on line 18 of page 27 therein, and are incorporated herein by reference.

Exposure and Development

Photographic elements can be exposed to actinic radiation, typically in the visible region of the spectrum, to form a latent image as described in Research Disclosure, Section XVIII and then processed to form a visible dye image as described in Research Disclosure, Section XIX. Processing to form a visible dye image includes the step of contacting the element with a color developing agent to reduce developable silver halide and oxidizing the color developing agent. Oxidized color developing agent in turn reacts with the coupler to release a diffusible dye. Said contacting of the element with a color developing. agent comprises wetting at least the emulsion side of said element with a volume of processing solution that exceeds the swelling volume of the element.

With negative working silver halide, the processing step described above gives a negative image. To obtain a positive (or reversal) image, this step can be preceded by development with a nonchromogenic developing agent to develop exposed silver halide, but not form dye, and then uniformly fogging the element to render .unexposed silver halide developable. Alternatively, a direct positive emulsion can be employed to obtain a positive image.

Aqueous development utilizing primary amine reducing agents is typically used. Color developing agents which are useful with the nondiffusing dye-releasing couplers and compounds of this invention include the following:

4-amino-N-ethyl-3-methyl-N-β-sulfoethyl) aniline 4-amlno-N-ethyl-3-methoxy-N-(β-sulfoethyl ) aniline 4-amlno-N-ethyl-N-(-hydroxyethyl)aniline 4-amlno-N,N-diethyl-3-hydroxymethyl aniline 4-amlno-N-methyl-N-(β-carboxyethyl)aniline 4-ammno-N,N-bis-(β-hydroxyethyl)aniline 4-ammno-N, N-bis-(β-hydroxyethyl)-3-methyl-aniline 3-acetamido-4-amino-N,N-bis-(β-hydroxyethyl) aniline 4-amino-N-ethyl-N-(2,3-dihydroxypropoxy)-3-methyl aniline sulfate salt 4-amino-N,N-diethyl-3-(3-hydroxypropoxy)aniline After image formation the element is subjected to a stop and wash bath that may be the same or different. Thereafter, the element is dried. Said stop, wash, or drying steps may be omitted.

Diffusion Dye Transfer

Heating times of from about 10 seconds to 30 minutes at temperatures of from about 50 to 200° C. (more preferably 75° to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75° to 190° C. Particularly useful methods of heating and stripping are described by Texter et al. in U.S. Pat. No. 5,164,280 and by Lynch and Texter in U.S. Pat. No. 5,294,514, the disclosures of which are incorporated herein in their entireties.

The advantages of the present invention will become more apparent by reading the following examples. The scope of the present invention is by no means limited by these examples, however.

EXAMPLES

Comparison Examples

Yellow dye-forming coupler Y-1 described by Willis and Texter in heat image separation systems as disclosed in U.S. Pat. No. 5,270,145, yellow dye-forming polymeric coupler Y-2 described by Texter et al. in U.S. application Ser. No. 07/927,691, now U.S. Pat. No. 5,354,642, and yellow azo-dye releasing coupler Y-3 described by Texter et al. in U.S. application Ser. No. 07/993,580, now U.S. Pat. No. 5,356,750, are utilized as comparisons to the performance of the dye-releasing couplers of the present invention.

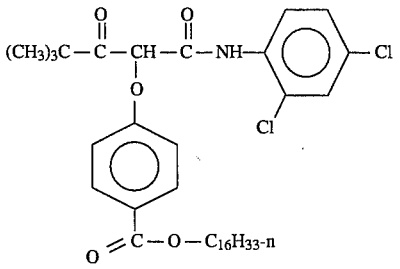

Y-1

-continued

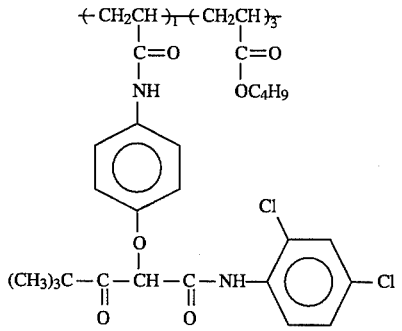

Y-2

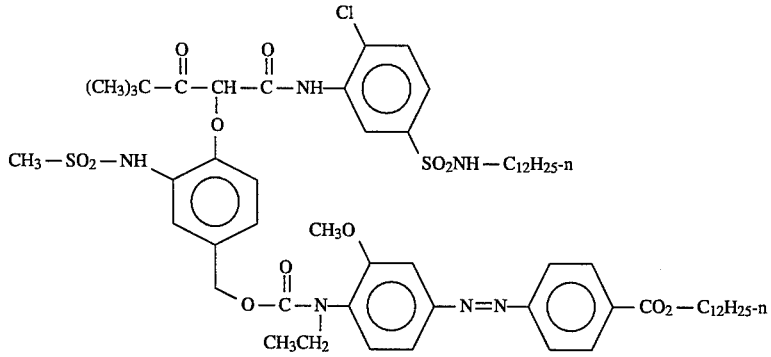

Y-3

Preparation of Invention Methine-Dye Releasing Coupler Y-4

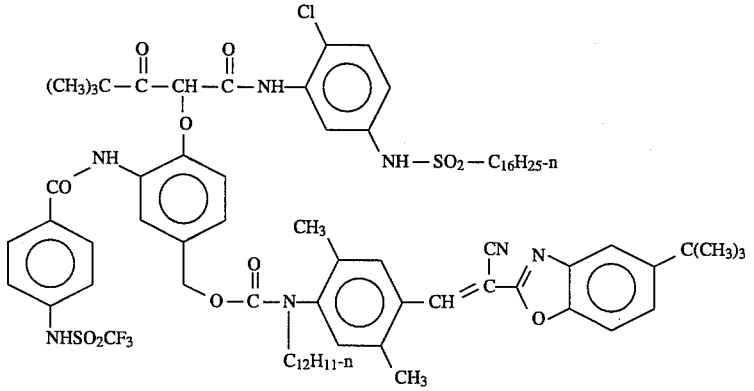

Y-4

The overall scheme for the synthesis of dye-releasing coupler Y-4 is illustrated in Scheme 1. The linking group intermediate i-1 is prepared in four steps. Commercially available methyl-p-amino benzoate (78.6 g, 0.52 mole) is dissolved in about 500 ml of methylene chloride containing 2,6-lutidine (56 g, 0.52 mole, 60.7 ml), cooled in an ice bath and treated with trifluoromethane sulfonic anhydride (146 g, 0.52 mole/l in 50 ml of methylene chloride) dropwise over 5 minutes. The reaction mixture is warmed to room temperature over 30 minutes before washing with excess 2N HCl. The organic phase is then washed four times with 250 ml portions of iN $NaHCO_3$. The aqueous washes are acidified with 12N HCl to precipitate a creamy solid which is collected, washed with water, and air dried to yield 86 g of the trifluoromethyl-sulfonamide (methyl-p-trifluoromethyl-sulfonamido benzoate). This trifluoromethylsulfonamide (86 g, 0.3 mole) is added to a stirred solution of NaOH (55 g, 1.38 mole) in 660 ml of water. The mixture is stirred for about 15 minutes before acidifying with excess 2N HCl to yield a precipitate that is collected, washed with water, and air dried to yield 72 g of the saponofied benzoic acid. This benzoic acid (74.9 g, 0.278 mole) is converted to acid chloride by stirring in a mixture of 350 ml ethyl acetate, 3 drops of DMF, and 53 g (0.417 mole) oxalyl chloride for 3 hours. Solvents Scheme 1

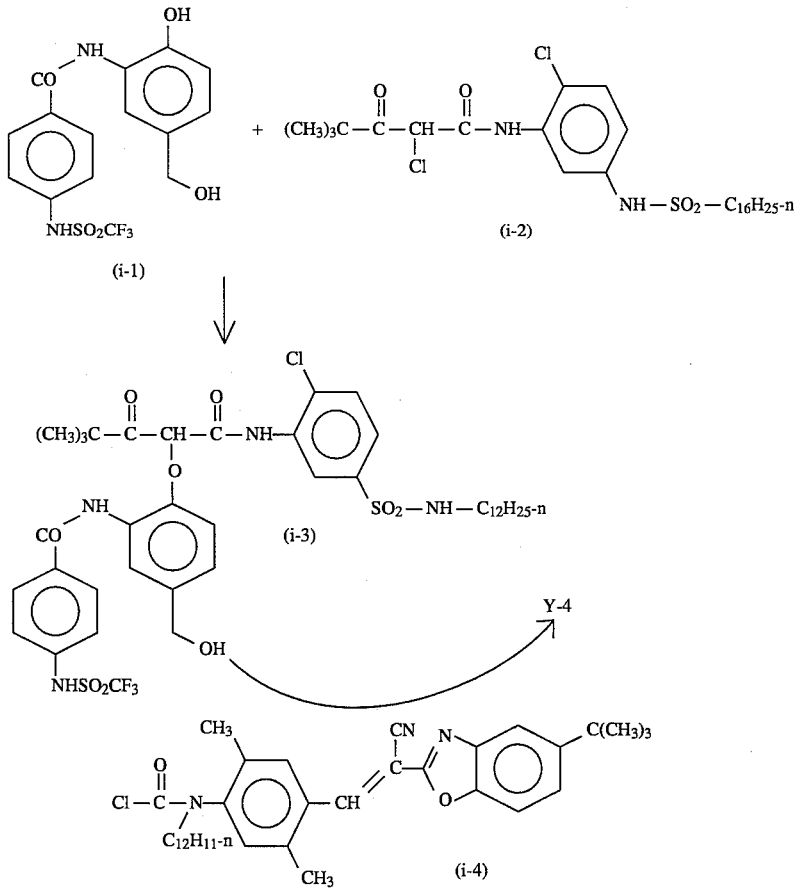

are distilled off under vacuum and residual oxalyl chloride is chased three times with a mixture of 150 ml methylene chloride and 50 ml heptane. The crude oil is mixed with 25 ml of heptane and placed in a refrigerator overnight. The crystals that form are slurried in about 200 ml of heptane and air dried to yield 57.6 g of the acid chloride. This acid chloride (57.6 g, 0.198 mole, in 100 ml tetrahydrofuran) is added dropwise over ten minutes with good stirring to a solution of 3-amino-4-hydroxy benzyl alcohol (27.5 g, 0.198 mole) in 100 ml of pyridine cooled to 5° C. in a 3-neck round bottom flask fitted with mechanical stirrer. After 30 minutes at room temperature the reaction mixture is diluted with 300 ml of ethyl acetate and washed with excess 2N HCl and water. The organic layer is dried over $MgSO_4$ and stripped to a crude oil that crystallized rapidly with addition of 200 ml heptane. The crystals are collected and air dried to yield 69 g of the linking group i-1.

This linking group i-1 is attached to coupler i-2 by combining 32 g (0.082 mole) of i-1 and 48.5 g (0.082 mole) of i-2 with 200 ml of DMF and treating with tetramethylguanidine (18.8 g, 0.164 mole). The reaction mixture is stirred for 2 hours and then diluted with ethyl acetate and washed with excess 1N HCl and water. The organic layer is dried over $MgSO_4$ and concentrated to an 5 oil. The oil is dissolved in 2 parts of ethyl acetate and diluted with 8 parts heptane. The solvents are evaporated with stirring to yield brown crystals. These crystals are slurried in heptane, collected, and air dried to yield about 60 g of coupler i-3.

The dye intermediate i-4 is prepared according to Scheme 2, illustrated below. Commercially available 2,5-dimethyl aniline (50 g, 0.413 mole) is added to formic acid (46 g, 1 mole, 38 ml) in a round bottom flask fitted with a condenser and heating mantle. The mixture is heated to reflux for 2 hours and then cooled to room temperature before pouring into 2 liters of cold water with good stirring. The resulting precipitate is collected and air dried to yield 61 g of the formamide (2,5-dimethylformanilide). This formamide (59.6 g, 0.4 mole) and bromodecane (104.6 g, 0.4 mole) are mixed with 40 ml t-butanol and 400 ml THF in a 3-neck round bottom flask fitted with a reflux condenser, heating mantle, and nitrogen purge. The mixture is treated with potassium t-butoxide (49.2 g), heated to reflux for 12 hours, cooled to room temperature, and diluted with ethyl acetate. The mixture is then washed with excess 1N HCl and water. The organic layer is dried over $MgSO_4$ and concentrated to yield about 120 g of crude alkylated formamide. Alkylated formamide (120 g, 0.38 mole) is dissolved in 420 ml acetic acid and 120 ml 12N HCl and heated to reflux for 16 hours. The solvents are distilled off under vacuum and the resulting oil is slurried with 200 ml heptane to enhance precipitate formation. The precipitate is collected and air dried to yield 107 g of the corresponding amine hydrochloride (2,5-dimethyl-N-dodecyl aniline hydrochloride). This amine hydrochloride (34.2 g, 0.0105 mole) is mixed with 250 ml acetic acid, 20 ml 12N HCl, and 20 ml formaldehyde in a large mouth 3-liter round bottom flask fitted with a mechanical stirrer and a heating mantle. The mixture is heated to about 80° C. before removing the heat and treating with N,N-dimethylnitrosoaniline (22.5 g, 0.15 mole) in portions over a ten minute interval with good stirring. The solvents are distilled off under vacuum and the resulting oil is dissolved in 300 ml of ethyl acetate and excess 2N HCl. The aqueous phase is washed an additional three times with 300 ml portions of ethyl acetate. These ethyl acetate extracts are passed through a pad of silica gel before removing solvent under vacuum to yield a slurry that crystallizes with the addition of 500 ml of heptane. The crystals are collected and air dried to yield 17 g of the aldehyde (2,5-dimethyl-4-dodecylamino-benzaldehyde; DMBA).

Commercially available 4-t-butyl phenol (30 g, 0.2 mole) is dissolved in 200 ml ethyl acetate in a 500 ml round bottom flask fitted with a mechanical stirrer, and cooled to 0° C. The mixture is treated with nitric acid (13 ml, in 13 ml water) dropwise over 10 minutes and then a catalytic amount of $NaNO_2$. After 45 minutes the reaction is washed with excess 1N HCl and the organic layer is dried over $MgSO_4$ and stripped to yield 37 g of 2-nitro-4-t-butyl phenol. This nitrophenol (37 g, 0.19 mole) is dissolved in 100 ml ethyl acetate and placed into a parr bottle with a teaspoon of 10% Pd/C. The mixture is placed on a hydrogenator under 50 psi hydrogen with agitation for one hour. The catalyst is filtered off through celite, and the ethyl acetate is stripped off under vacuum. The material crystallizes with the addition of about 200 ml heptane to give 25.6 g of the corresponding amine (2-amino-4-t-butyl phenol).

Scheme 2

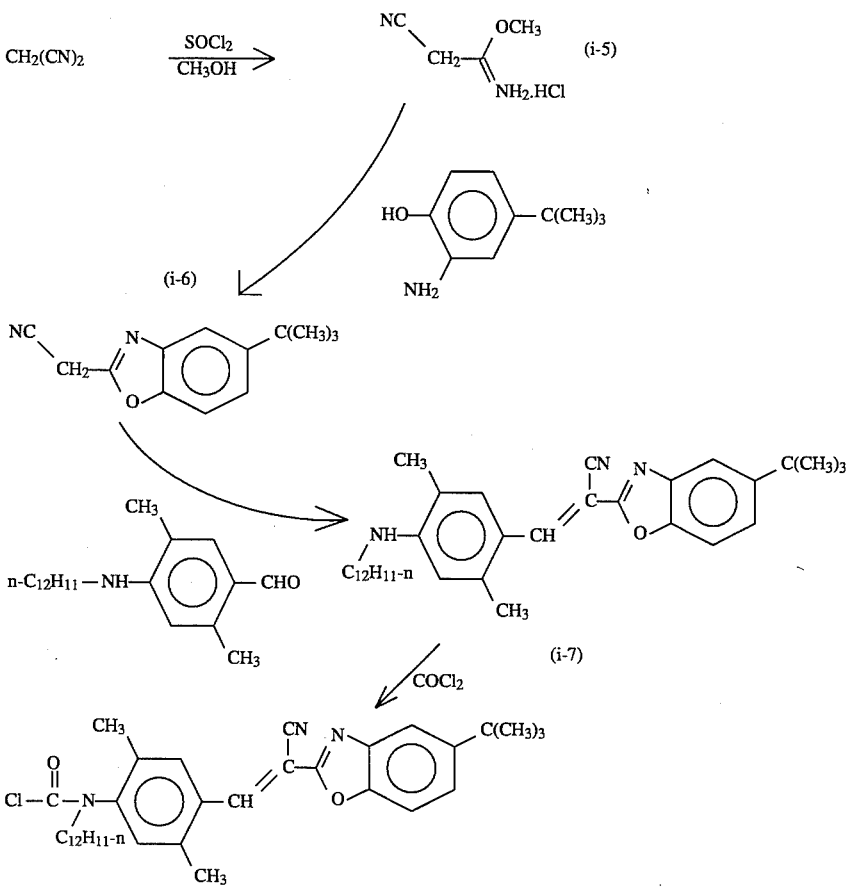

Malononitrile (39.6 g, 0.6 mole) is dissolved in methanol (38 g, 1.2 mole, 48 ml) and 200 ml of methyl formate in a 1-liter 3-neck round bottom flask fitted with an ice bath and addition funnel. The mixture is cooled to 10° C. and treated dropwise over five minutes with thionyl chloride (55 g, 0.46 mole, 33.6 ml). A precipitate forms after 30 minutes and an additional 100 ml of methyl formate is added. After 1 hour the precipitate is collected and air dried for 20 minutes to yield 52 g of the corresponding imine salt intermediate i-5. This salt is stored in an air-tight bottle purged with nitrogen. This imine salt (10.7 g, 0.08 mole) and 2-amino-4-t-butyl phenol (6.6 g, 0.04 mole) are heated with 100 ml methanol at 60° C. for 10 minutes before diluting with 200 ml of ethyl acetate and excess water. The organic layer is dried over $MgSO_4$ and stripped to yield 8.6 g of the benzoxazole i-6. This oil (4.5 g, 0.02 mole) and aldehyde DMBA (6.7 g, 0.02 mole) in 80 ml acetic acid and 3 drops of triethylamine are heated to 80° C. for 15 minutes and then stirred overnight at room temperature to give a slurry of crystals. The crystals are collected and washed with 100 ml methanol to give two crops yielding about 7 g of the methine-dye i-7. This dye (3.5 g, 0.0068 mole) is dissolved in about 25 ml methylene chloride and 2,6-lutidine (1.9 g, 0.017 mole). The mixture is treated with phosgene (1.93M in toluene, 0.014 mole, 7.2 ml) over a 1 minute interval. After 10 minutes the mixture is washed in a separatory funnel with excess cold 1N HCl, and then with cold water. The organic phase is dried over $MgSO_4$ and stripped to yield 3.7 g of the carbamoyl chloride i-4. After scale-up, this carbamoyl chloride (17.9 g, 0.031 mole) is reacted with coupler i-3 (29.3 g, 0.031 mole) in a 1-liter 3-neck round bottom flask fitted with nitrogen purge and containing dimethylamino pyridine (3.8 g, 0.031 mole) and 150 ml methylene chloride. The mixture is treated with DBU (14.1 g, 0.093 mole), stirred for 4 hours, diluted with ethyl acetate, and washed with excess 1N HCl and water. The organic layer is dried over $MgSO_4$ and concentrated to a crude oil that is chromatographed on silica gel using methylene chloride/heptane/ethyl acetate (5/3/2) as the eluent. About 20.5 g of Y-4 is obtained as a foam.

Preparation of Invention Methine-Dye Releasing Coupler Y-5

Methine-dye releasing coupler Y-5 is prepared by the methods similar to those described above for the preparation of Y-4.

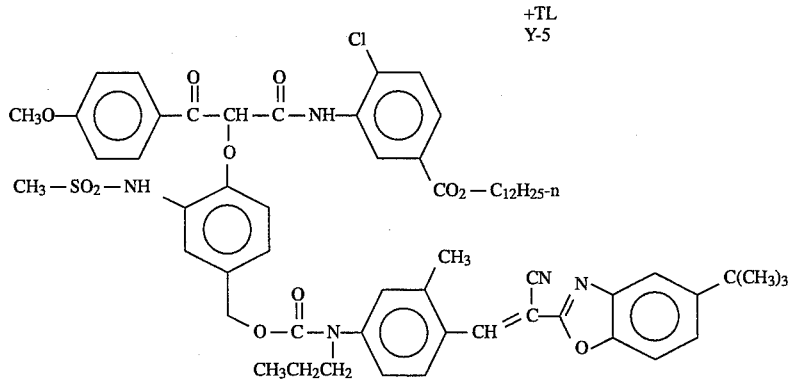

Dispersions and Coatings

Thermal solvent dispersions are prepared according to the following procedure: An aqueous solution is prepared at about 50° C. by combining 3.75 g of 10% (w/w) aqueous Alkanol XC (Du Pont), 30 g of 12.5% (w/w) gelatin, an 78.75 g water. About 12.5 g of 2'-ethylhexyl-4-hydroxy benzoate is added to this solution with stirring, and this coarse emulsion is then passed through a colloid mill five times to produce a fine particle sized dispersion. This thermal solvent dispersion is then chill set and stored in the cold until used.

Dispersions of the comparison and invention dye-forming and dye-releasing couplers are prepared similarly. For example, a dispersion of the comparison coupled Y-1 is prepared according the following procedure: About 8 g of Y-1 are dissolved in 24 g of ethyl acetate at about 60° C. An aqueous gelatin solution comprising 3.2 g of 10% (w/w) Alkanol-XC (Du Pont). 19.2 g 12.5% (w/w) aqueous gelatin, and 19.2 g water is prepared. These aqueous and ethyl acetate solutions are then combined with stirring and passed through a colloid mill five times to obtain a fine particle dispersion of Y-1. The resulting dispersion is chill set, noodled, and washed for about 4 h to remove the ethyl acetate. This dispersion is then remelted, chill set, and stored in the cold until used. A dispersion of Y-3 is prepared by mixing a solution comprising 0.86 g of Y-3 with 1.2 g of ethylacetate with an aqueous mixture comprising 1.6 g of 10% aqueous Alkanol-XC, 6.95 g of 12.5% (w/w) gelatin, 0.89 g thermal solvent, and 24.38 g water. This mixture is passed through a colloid mill three times to obtain a fine particle dispersion of Y-3, and the resulting dispersion is chill set and stored in the cold until used. A dispersion of Y-4 is prepared by mixing a solution comprising 3 g of Y-4 with 9 g of ethylacetate with an aqueous solution comprising 3 g of 10% aqueous Alkanol-XC, 19.2 g of 12.5% (w/w) gelatin, and 45.8 g water. This mixture is passed through a colloid mill five times to obtain a fine particle dispersion of Y-4, and the resulting dispersion is chill set and is stored in the cold until used. A dispersion of Y-5 is prepared by mixing a solution comprising 4 g of Y-5 and 2 g of di-n-butyl phthalate with 12 g of ethylacetate with an aqueous mixture comprising 4 g of 10% aqueous Alkanol-XC, 33.33 g of 9% (w/w) gelatin, and 44.67 g water. This mixture is passed through a colloid mill five times to obtain a fine particle dispersion of Y-5 , and the resulting dispersion is chill set, noodled, and washed for 3 h to remove the ethyl acetate. This dispersion is then remelted, chill set, and stored in the cold until used.

In these dispersions and coating melts of Y-3, Y-4, and Y-5, the ethylacetate is removed by evaporation during subsequent coating. The comparison polymeric coupler Y-2 is prepared as a latex and stored as an aqueous latex suspensions.

The test coating structure comprising several layers is illustrated below as the Example Element Layer Structure.

The dye-receiving layer comprises polycarbonate and polycaprolactam and is coated on titania pigmented reflection paper base. This titania pigmented paper base is resin coated with high density polyethylene, and coated with a mixture of polycarbonate, polycapro-lactone, and 1,4-didecyloxy-2,5-dimethoxy benzene at a 0.77:0.115:0.115 weight ratio respectively, at a total coverage of 3.28 g/m$^2$. This polymeric dye-receiving layer is subjected to

| Example Element Layer Structure |
|---|
| Overcoat Layer |
| Gelatin (1.07 g/m$^2$) |
| Imaging Layer |
| Blue sensitized AgCl emulsion (0.537 g/m$^2$) |
| Dye-releasing Coupler (0.857–1.66 mmol/m$^2$) |
| Thermal Solvent (1.07–1.61 g/m$^2$) |
| Gelatin (0.644–2.12 g/m$^2$) |
| Dye-Receiving Layer |
| Support |

3a corona discharge bombardment within 24 h prior to coating the test elements. The imaging layer contains gelatin at a coverage of 0.644–2.12 g/m$^2$, thermal solvent (2'-ethylhexyl-4-hydroxy benzoate) at a coverage of about 0.687–1.61 g/m$^2$, and blue sensitized silver chloride at a coverage of about 540 mg/m$^2$ as silver. Coatings of Y-1 and of Y-3 contain 1.07 g/m$^2$ of gelatin and 1.07 g/m$^2$ of thermal solvent in the imaging layer. Coatings of Y-2 contain 0.644 g/m$^2$ of gelatin and 1.07 g/m$^2$ of thermal solvent in the imaging layer. Coatings of Y-4 contain 2.12 g/m$^2$ of gelatin and 1.61 g/m$^2$ of thermal solvent in the imaging layer. Coatings of Y-5 contain 1.61 g/m$^2$ of gelatin and 1.61 g/m$^2$ of thermal solvent in the imaging layer. The imaging layer is overcoated with a protective overcoat layer. The overcoat layer contains gelatin at a coverage of about 1.07 g/m$^2$. Hardener, 1,1'-[methylene bis(sulfonyl)]bis-ethene (MBSE), is coated at a level corresponding to 1.5% by weight of the total gelatin coated. Deionized bone gelatin, Type IV, is used.

Processing and Sensitometry

These test coatings are exposed for 0.01 s to a tungsten light source (2850° K.) through a 0–3 density 21-step tablet and developed at 35° C. according to the following procedure. This process comprises development for 45 sec in a large volume of developer solution, a 60 sec stop, a 60 sec rinse in a pH 7 buffer, washing in water for 90 sec, all at 35° C., and drying. The developer solution is prepared according to the following composition:

| | |
|---|---|
| Triethanolamine | 12.41 g |
| Phorwite REU (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |
| pH 10.04 ± 0.05 at 80° F. | |

After drying the overcoat and imaging (emulsion and dye-releasing) layers comprising the donor element are removed (stripped) from the receiving/base layers (receiver element) using the method described by Texter et al. in U.S. Pat. No. 5,164,280. The emulsion side of the dried and processed test coatings is contacted with the gel subbed (107 mg/m$^2$) side of an ESTAR adhesive element and passed 1, 3, or 10 times at a rate of about 5 mm/s through pinch rollers heated to a surface temperature of 110° C. and held together under a pressure of 20 psi. The receiver elements are then pulled apart from the ESTAR adhesive element, and the donor layers are, thereby, stripped at the imaging layer—receiving layer interface and remain

TABLE 1

| Example | Coupler (eq. wt.) | Dye Transfer Densities: Coupler Level (CL) (mmol/m$^2$) | Heat Treatment (Passes) | Dmax (OD) | Dmax/CL (OD/mmol/m$^2$) |
|---|---|---|---|---|---|
| 1 | Y-1 (648.6) | 1.32 | 1 | 0.47 | 0.35 |
| 2 | Y-1 (648.6) | 1.32 | 3 | 0.58 | 0.44 |
| 3 | Y-1 (648.6) | 1.32 | 10 | 0.61 | 0.46 |
| 4 | Y-2 (834) | 1.66 | 1 | 1.46 | 0.88 |
| 5 | Y-2 (834) | 1.66 | 3 | 1.58 | 0.95 |
| 6 | Y-2 (834) | 1.66 | 10 | 1.65 | 0.99 |
| 7 | Y-3 (1210) | 0.857 | 1 | 1.41 | 1.65 |
| 8 | Y-3 (1210) | 0.857 | 3 | 1.57 | 1.83 |
| 9 | Y-3 (1210) | 0.857 | 10 | 1.52 | 1.77 |
| 10 | Y-4 (1485) | 0.959 | 1 | 1.87 | 1.95 |
| 11 | Y-4 (1485) | 0.959 | 3 | 2.02 | 2.11 |
| 12 | Y-4 (1485) | 0.959 | 10 | 2.06 | 2.15 |
| 13 | Y-5 (1131) | 0.959 | 1 | 1.50 | 1.56 |
| 14 | Y-5 (1131) | 0.959 | 3 | 1.65 | 1.72 |
| 15 | Y-5 (1131) | 0.959 | 10 | 1.68 | 1.75 |

attached to the adhesive element. The donor layers contain undeveloped AgCl, the silver image, most of the unreacted coupler, and a small fraction of the image dye formed. The receiver elements, on the other hand, retain most of image dye formed during color development. Reflection dye densities in the Dmax regions of the dye receiver elements are then read with a densitometer using status-A filters. These values are listed in Table 1 for Examples 1–15 and illustrate that excellent dye-diffusion transfer may be obtained in the elements of this invention. Invention examples 10–15 for invention mehine-dye releasing couplers Y-4 and Y-5 yield dye transfer densities that are far superior to those obtained in comparison examples 1–6 for comparison couplers Y-1 and Y-2. Examples 10–12 for invention methine-dye releasing coupler Y-4 illustrate superior dye transfer density to comparison examples 7–9 for comparison azo-dye releasing coupler Y-3. Invention examples 10–15 for invention methine-dye releasing couplers Y-4 and Y-5 provide transferred dye hues that are more lemon-yellow and are preferred over the yellow-orange azo dye due obtained in comparison examples 7–9 for comparison azo-dye releasing coupler Y-3.

The present invention has been described in some detail with particular reference to preferred embodiments thereof. It will be understood that variations and modifications can be effected within the spirit and scope of the present invention.

What is claimed is:

1. An aqueous-developable photographic color diffusion transfer element comprising one and only one dimensionally stable support and one or more layers comprising radiation sensitive silver halide, thermal solvent for facilitating the thermal diffusion of dyes through a hydrophilic binder, a methine-dye releasing coupler, and hydrophilic binder, wherein said dye is heat diffusible in said binder and thermal solvent, and wherein said methine-dye releasing coupler is of the structure (I)

$$Cp—L—M \quad (I)$$

where

Cp is a coupler radical substituted in the coupling position with a divalent linking group, L;

M is a methine-dye radical exhibiting selective absorption in the visible spectrum; and where the —L—M group couples off upon reaction of said coupler radical with the oxidation product of a primary amine developing agent, and where said methine-dye radical M is released from said —L—M group subsequent to the coupling off of said —L—M group.

2. An element as in claim 1, which in addition contains a dye-receiving layer intermediate said support and said silver halide containing and said dye-releasing coupler containing layers.

3. An element as in claim 2, where said dye-receiving layer comprises polymer selected from the group consisting of poly-carbonates, polyurethanes, polyesters, polyvinyl chlorides, poly (styrene-co-acrylonitrile)s, poly (caprolactone) s and mixtures thereof.

4. An element as in claim 2, which in addition contains a stripping layer intermediate said dye-receiving layer and said silver halide containing and said dye-releasing coupler containing layers.

5. An element as in claim 4, wherein said stripping layer contains a stripping agent coated at levels of 3–500 mg/m$^2$.

6. An element as in claim 5, wherein said stripping agent has the following formula:

$$CF_3(CF_2)_n—SO_2—\overset{R_1}{\overset{|}{N}}—CH_2R_2$$

wherein $R_1$ is selected from the group consisting of alkyl groups having from 1 to 6 carbon atoms, substituted alkyl groups having from 1 to 6 carbon atoms, aryl groups having from 6 to 10 carbon atoms, and substituted aryl groups having from 6 to 10 carbon atoms; $R_2$ is selected from the group consisting of $$—\overset{O}{\overset{||}{C}}—O—(CH_2CH_2O)_x—R_3,$$

$$—\overset{O}{\overset{||}{C}}—O—(CH_2)_y—R_3,$$

and $$—CH_2—O—(CH_2CH_2O)_z—R_3;$$

$R_3$ is H or $R_1$; n is an integer from 4 to 19; x and y each independently represents an integer of from 2 to 50; and z represents an integer of from 1 to 50.

7. An element as in claim 6, wherein $R_1$ is ethyl, $R_2$ is $$—\overset{O}{\overset{||}{C}}—O\leftarrow CH_2CH_2O\rightarrow_x H,$$

n is 6 to 8, and x is 25 to 50.

8. An element as in claim 6, wherein $R_1$ is ethyl, $R_2$ $$—\overset{O}{\overset{||}{C}}—O\leftarrow CH_2\rightarrow_y H,$$

n is 6 to 8, and y is 25 to 50.

9. An element as in claim 1, wherein said silver halide comprises greater than 95 mole percent silver chloride.

10. An element as in claim 1, devoid of any interlayer containing oxidized developer scavenger of the reducing agent type.

11. An element as in claim 1, essentially devoid of any developing agent, reducing agent, or electron transfer agent.

12. An element as in claim 1, wherein said binder is selected from the group consisting of gelatin, polyvinylpyrrolidone, and polyvinylalcohol.

13. An element as in claim 1, wherein said binder is gelatin.

14. An element as in claim 1, wherein said thermal solvent is selected from the group consisting of phenols, benzamides, hydroxybenzoates, and hydroxybenzamides.

15. An element as in claim 1, wherein said thermal solvent is present at a thermal solvent-to-binder weight ratio of 0.1 to 2.

16. An element as in claim 1, wherein said linking group is selected from the group consisting of L-1, L-2, L-3, L-4, L-5, L-6, L-7, L-8, L-9, L-10, L-11, L-12, L-13, and L-14:

L-1

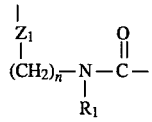

where n is 1, 2, 3, or 4;

L-2

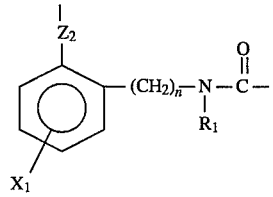

L-3

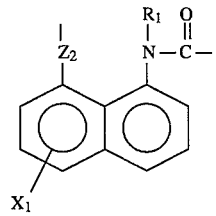

where n is 0 or 1;

L-4

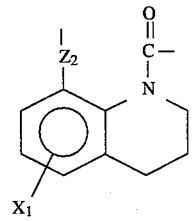

-continued

L-5

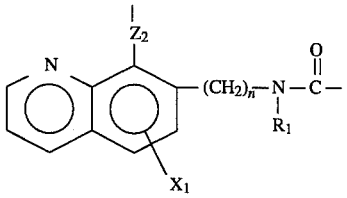

L-6

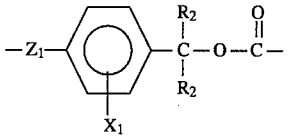

L-7

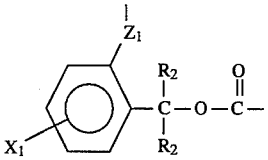

L-8

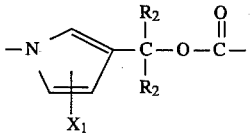

L-9

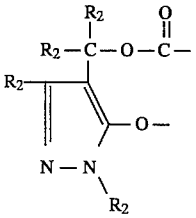

L-10

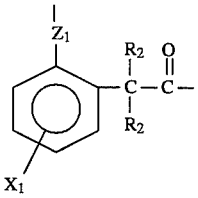

L-11

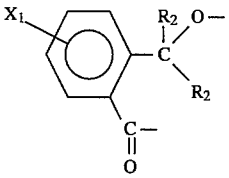

L-12

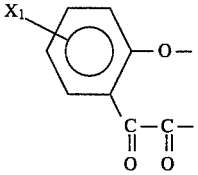

L-13

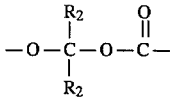

-continued

L-14

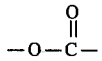

wherein

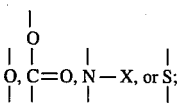

where X is a substituent;

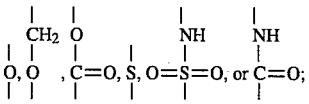

$R_1$ is selected from the group consisting of a hydrogen atom, alkyl of 1 to 18 carbon atoms, and aryl of 6 to 30 carbon atoms;

each $R_2$ independently is selected from the group consisting of a hydrogen atom, alkyl of 1 to 25 carbon atoms, cycloalkyl, substituted cycloalkyl, and aryl of 6 to 30 carbon atoms;

$X_1$ is selected from the group consisting of a hydrogen atom, cyano, fluoro, chloro, bromo, iodo, nitro, alkyl of 1 to 18 carbon atoms, aryloxy, alkoxycarbonyl, hydroxy, sulfonyl, acyl, alkoxy, sulfo, $—OR_2$, $—COOR_2$, $—CONHR_2$, $—NHCOR_2$, $—NHSO_2R_2$, $—SO_2NHR_2$, and $—SO_2R_2$.

17. An element as in claim 1, wherein said mehine-dye radical M is given by structure (III):

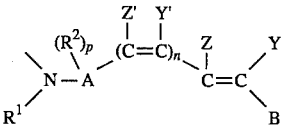

(III)

wherein $R^1$ is hydrogen or a substituted or unsubstituted alkyl or aryl (including heteroaryl) group;

A is a substituted or unsubstituted aryl (including heteroaryl) ring;

each $R^2$ is independently a substituted or unsubstituted alkyl group which may form a ring with Z' or z when n=0;

p is an integer from 0 to 3;

each Z, Z', and Y' is independently hydrogen or a substituent;

Y is an electron withdrawing group;

n is 0, 1, or 2; and

B is a heterocycle having the formula (IV):

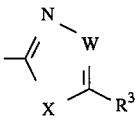

(IV)

wherein:

X is O, S, or $N(R^5)$ where $R^5$ is hydrogen or alkyl;

W is N or $C(R^4)$ where $R^4$ is hydrogen or a substituent;

$R^3$ is a substituent linked to the heterocycle by a carbon or nitrogen atom of the substituent;

provided that $R^3$ and $R^4$ may be linked to form a ring.

18. A diffusion transfer process for forming a color photographic image comprising the steps of:

providing an aqueous-developabe photographic color diffusion transfer element comprising one and only one dimensionally stable support and one or more layers comprising radiation sensitive silver halide, thermal solvent for facilitating the thermal diffusion of dyes through a hydrophilic binder, a mehine-dye releasing 0 coupler, and hydrophilic binder, wherein said dye is heat diffusible in said binder and thermal solvent, and wherein said methine dye-releasing coupler is of the structure (I)

$$Cp—L—M \quad (I)$$

where

Cp is a coupler radical substituted in the coupling position with a divalent linking group, L;

M is a mehine-dye radical exhibiting selective absorption in the visible spectrum; and where the —L—M group couples off upon reaction of said coupler radical with the oxidation product of a primary amine developing agent, and where said radical M is released from said —L—M group subsequent to the coupling off of said —L—M group;

exposing said element to actinic radiation;

processing said element by immersing said element in an external aqueous bath containing color developer of the primary amine type;

washing said element;

drying said element to remove the imbibed water; and heating said element to effect dye diffusion transfer to an image receiving layer.

19. A process as in claim 18, wherein said diffusion transfer element in addition contains a dye-receiving 35 layer intermediate said support and said silver halide containing and said dye-releasing coupler containing layers.

20. A process as in claim 19, wherein said dye-receiving layer comprises polymer selected from the group consisting of poly-carbonates, polyurethanes, polyesters, polyvinyl chlorides, poly(styrene-co-acrylonitrile)s, poly(caprolactone)s and mixtures thereof.

21. A process as in claim 20, wherein said diffusion transfer element comprises a stripping layer intermediate said dye-receiving layer and said silver halide containing and said dye-releasing coupler containing layers.

22. A process as in claim 21, wherein said stripping layer contains a stripping agent coated at levels of 3–500 mg/m$^2$.

23. A process as in claim 22, wherein said stripping agent has the following formula:

$$CF_3(CF_2)_n—SO_2—\overset{\overset{R_1}{|}}{N}—CH_2R_2$$

wherein $R_1$ is selected from the group consisting of alkyl groups having from 1 to 6 carbon atoms, substituted alkyl groups having from 1 to 6 carbon atoms, al groups having from 6 to 10 carbon atoms, and substituted aryl groups having from 6 to 10 carbon atoms; $R_2$ is selected from the group consisting of $$—\overset{\overset{O}{||}}{C}—O—(CH_2CH_2O)_x—R_3,$$

$$—\overset{\overset{O}{||}}{C}—O—(CH_2)_y—R_3,$$

and $$—CH_2—O—(CH_2CH_2O)_z—R_3;$$

$R_3$ is H or $R_1$; n is an integer from 4 to 19; x an Y each independently represents an integer of from 2 to 50; and z represents an integer of from 1 to 50.

24. A process as in claim 18, wherein said silver halide comprises greater than 95 mole percent silver chloride.

25. A process as in claim 18, wherein said diffusion transfer element is essentially devoid of any developing agent, reducing agent, or electron transfer agent.

26. A process as in claim 18, wherein said binder is selected from the group consisting of gelatin, polyvinylpyrrolidone, and polyvinylalcohol.

27. A process as in claim 18, wherein said process is devoid of any fixing step.

28. A process as in claim 18, wherein said process is devoid of any bleaching step.

29. A process as in claim 18, wherein said process further comprises immersing said element in a stop bath before or during said washing step.

30. A process as in claim 18, wherein said methine-dye radical M is given by structure (III):

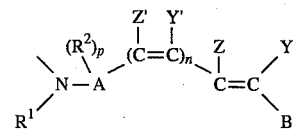

(III)

wherein $R^1$ is hydrogen or a substituted or unsubstituted alkyl or aryl or heteroaryl group;

A is a substituted or unsubstituted aryl or heteroaryl ring;

each $R^2$ is independently a substituted or unsubstituted alkyl group which may form a ring with Z' or Z when n=0;

p is an integer from 0 to 3;

each Z, Z', and Y' is independently hydrogen or a substituent;

Y is an electron withdrawing group;

n is 0, 1, or 2; and

B is a heterocycle having the formula (IV):

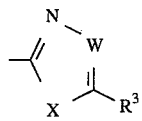

(IV)

wherein:

X is O, S, or $N(R^5)$ where $R^5$ is hydrogen or alkyl;

W is N or $C(R^4)$ where $R^4$ is hydrogen or a substituent;

$R^3$ is a substituent linked to the heterocycle by a carbon or nitrogen atom of the substituent;

provided that $R^3$ and $R^4$ may be linked to form a ring.

* * * * *